US009945228B2

(12) United States Patent
Mancini

(10) Patent No.: US 9,945,228 B2
(45) Date of Patent: Apr. 17, 2018

(54) DRILLING SYSTEM FAILURE RISK ANALYSIS METHOD

(71) Applicant: Halliburton Energy Services, Inc., Houston, TX (US)

(72) Inventor: Stefano Mancini, Ravenna (IT)

(73) Assignee: Halliburton Energy Services, Inc., Houston, TX (US)

( * ) Notice: Subject to any disclaimer, the term of this patent is extended or adjusted under 35 U.S.C. 154(b) by 624 days.

(21) Appl. No.: 14/385,904

(22) PCT Filed: Mar. 6, 2013

(86) PCT No.: PCT/IB2013/000567
§ 371 (c)(1),
(2) Date: Sep. 17, 2014

(87) PCT Pub. No.: WO2013/140239
PCT Pub. Date: Sep. 26, 2013

(65) Prior Publication Data

US 2015/0081221 A1 Mar. 19, 2015

(30) Foreign Application Priority Data

Mar. 19, 2012 (GB) ..... 1204815.3

(51) Int. Cl.
*E21B 44/00* (2006.01)
*E21B 49/00* (2006.01)
*E21B 41/00* (2006.01)

(52) U.S. Cl.
CPC ..... *E21B 49/003* (2013.01); *E21B 41/0092* (2013.01); *E21B 44/00* (2013.01); *E21B 44/005* (2013.01)

(58) Field of Classification Search
CPC .... E21B 41/0092; E21B 44/00; E21B 44/005; E21B 49/003; E21B 3/02
(Continued)

(56) References Cited

U.S. PATENT DOCUMENTS 7,440,876 B2 10/2008 Geehan et al.
2002/0103630 A1 8/2002 Aldred et al.
(Continued)

FOREIGN PATENT DOCUMENTS

WO 2003089758 A1 10/2003
WO 2013016064 A2 1/2013

OTHER PUBLICATIONS

Search Report issued in related European Application No. 13764242.7, dated Jun. 7, 2016 (11 pages).
(Continued)

*Primary Examiner* — John H Le
(74) *Attorney, Agent, or Firm* — Alan Bryson; Baker Botts L.L.P.

(57) ABSTRACT

There is disclosed a method for assessing risk associated with drilling a section of a wellbore in a formation using a drilling system, including the steps of: providing a probabilistic model for the risk of the drilling system triggering a failure mode during drilling; and assessing the risk of the drilling system triggering one of the failure modes during drilling of the section based on the probabilistic model. A further such method includes the steps of defining the critical control parameters for the drilling system; and identifying one or more failure modes of the drilling system associated with each critical control parameter which may arise during drilling the section of the formation.

17 Claims, 8 Drawing Sheets

(58) Field of Classification Search
USPC ..... 702/9, 150; 166/207, 250.01; 175/25, 175/26, 140; 703/2, 10; 706/17
See application file for complete search history.

(56) References Cited

U.S. PATENT DOCUMENTS

| | | | | |
|---|---|---|---|---|
| 2004/0124009 | A1 | 7/2004 | Hoteit et al. | |
| 2005/0071120 | A1* | 3/2005 | Hutchinson ..... | E21B 47/04 702/150 |
| 2005/0279532 | A1* | 12/2005 | Ballantyne ..... | E21B 47/12 175/40 |
| 2009/0205819 | A1 | 8/2009 | Dale et al. | |
| 2011/0022554 | A1 | 1/2011 | Reckmann et al. | |
| 2011/0220410 | A1 | 9/2011 | Aldred et al. | |
| 2011/0307230 | A1 | 12/2011 | Lee et al. | |

OTHER PUBLICATIONS

Ken Malloy et al., "A Probabilistic Approach to Risk Assessment of Managed Pressure Drilling Offshore", Drilling Engineering Association, http://dea-global.org/?p=585, Feb. 19, 2004, pp. 1-22.
International Search Report issued in related PCT Application No. PCT/IB2013/00567 dated Jul. 18, 2013, 5 pages.
International Preliminary Report on Patentability issued in related PCT Application No. PCT/IB2013/00567 dated Jul. 7, 2014, 7 pages.
Office Action issued in related Canadian Application No. 2,867,110, dated Dec. 20, 2016 (10 pages).

* cited by examiner

DRILLING SYSTEM FAILURE RISK ANALYSIS METHOD

CROSS-REFERENCE TO RELATED APPLICATION

This application is a U.S. National Stage Application of International Application No. PCT/IB2013/000567 filed Mar. 6, 2013 which claims priority to Great Britain Patent Application No. 1204815.3 filed Mar. 19, 2012, which are hereby incorporated by reference in their entirety.

FIELD

The present invention relates to methods for assessing risk associated with drilling a section of a wellbore in a formation using a drilling system. The assessment method may be used in related methods for selecting a drilling system; for optimizing the performance of a drilling system; for planning a well drilling operation; and for drilling a wellbore in a formation. The invention also provides a method for assessing the ability of a drilling system to drill a section of a wellbore without triggering a failure mode of the drilling system. The invention further provides a related computer, computer-readable medium and drilling system.

BACKGROUND

In the oil well drilling industry, it is important to reduce the economic cost of drilling a wellbore in order to extract oil and gas from underground reservoirs. With underground resources becoming accessible at even greater depths, it becomes evermore important to identify the most efficient and effective drilling configuration to be used in order to drill through the intervening rock formation and access the underground reservoir.

The drilling environment is a complex environment to physically model and predict, and multiple constraints are placed, by the environmental conditions and the physical limits of the drilling system and its components, on the drilling system designer and drilling system operator. In the case of drilling system selection for a planned well drilling operation, this has led to a trial-and-error approach to selection optimization, based on data obtained from actual drilling operations conducted at a location offset from the planned well drilling operation. However, much of this selection optimization focuses on past performance values, even though the drilling conditions for the planned well drilling operation may not be identical, and on a perception of drilling system reliability that may not take into account all relevant factors determinative of the actual reliability of the different available candidate systems for the purposes of the planned well drilling operation.

One measure of the effectiveness of a drilling configuration is the absolute drilling performance which the drilling configuration can achieve through a particular section of formation. Drilling system design is typically concerned with optimizing the performance of a drilling system for drilling through a particular formation as economically as possible, which in most cases means drilling as quickly as possible (with the highest rate of penetration (ROP)) with the fewest number of changes of the bottom hole assembly (BHA). Of course, whenever the bottom hole assembly has to be changed, the existing bottom hole assembly and the entire drill string has to be tripped out of the wellbore being drilled, and a new bottom hole assembly and the same length of drill string has to be tripped back into the hole to recommence drilling. With ever deeper wells being drilled, this process takes correspondingly longer, with increasing attendant costs.

One reason for changing the bottom hole assembly is that one type of BHA may achieve a higher rate of penetration in one type of rock, or be cheaper, but will not achieve a sufficient rate of penetration or will quickly become worn in another type of formation, for which a different type or configuration of the BHA would obtain superior performance. Where changes in the formation rock types are identified and known in advance, a change of bottom hole assembly can be planned into the well drilling operation.

However, another cause of having to change the bottom hole assembly is where the BHA fails, in particular where a component of the BHA, such as the drill bit or an associated downhole tool becomes worn or damaged.

The amount of wear which a drill bit will suffer can be predicted with increasing accuracy, and can also be monitored in "real time" during drilling, for example by tracking the frequency response of the vibrations generated by the drill bit as it drills through rock. Nevertheless, drill bits can break or become worn more quickly than expected, and downhole tools can be damaged by vibrations and environmental conditions. For example, the teeth of a drill bit may become damaged and break through impacting against the formation.

Where the BHA fails in such a manner, it may become necessary not only to trip out the damaged BHA, but also to carry out a "fishing" operation to retrieve any damaged component of the BHA that has become detached and left at the bottom of the wellbore. This again adds to the time and cost of drilling the wellbore. Where the downhole tool becomes damaged, it will also likely be necessary to trip out the drill string and replace the damaged downhole tool, especially where the downhole tool is used to provide "look-ahead" or geo-positional information to help steer and position the bottom hole assembly.

Although such types of failure may be classified as unpredictable or random, it may be that, where the BHA has been designed to obtain a focused optimization of one property of the BHA for drilling under one specific set of expected drilling conditions, the chances of the BHA failing increase when the actual drilling conditions deviate away from the expected drilling conditions, or that the extent of the deviation from optimal which is required to induce such a failure decreases.

The same principle may apply not only to design and selection of the BHA, but to the drilling system as a whole, where the selection of the BHA and the choice of drilling control parameters has been subjected to focused optimization based on expected drilling conditions.

The principle may be described as "robustness"—whether the designed system will be robust to variations in operating conditions as these move away from the design point. Of course, during drilling operations there are continuously changing drilling conditions, due to changing characteristics of the rocks in the formation with depth. The drilling system operator also has a significant degree of freedom to alter the system control parameters. Again, the system control parameters are normally selected according to a drilling plan designed to optimize drilling performance as far as possible at each point along the wellbore, although without unnecessarily continuously varying selectable parameters, such as weight-on-bit (WOB), which in certain cases may not readily be varied without undesirably requiring drilling operations to stop. Additionally, actual drilling conditions may differ from the expected drilling conditions due to inherent inaccuracy in the measurement equipment and prediction methods used to determine the expected formation properties.

It would therefore be advantageous to be able to assess, and where possible to control or limit, the degree to which a drilling system is exposed to situations of high risk of failure.

It would furthermore be advantageous to be able to compare the expected response of different drilling systems in order to identify the relative risk of failure associated with each drilling system.

It may be advantageous to be able to compare values indicating the risk of failure and robustness to variations in operating conditions against expected performance when selecting between different available candidate drilling systems for drilling a planned wellbore.

It would be advantageous to permit a drilling system to be designed which optimizes or maintains a level of performance for the drilling system at the same time as reducing the risk of failure or keeping the risk of failure within acceptable levels. Likewise, it would be advantageous to be able to optimize drilling system performance whilst also optimizing or maintaining a required degree of robustness to variations in external drilling conditions.

In certain cases, it would be advantageous to be able to perform ongoing risk analyses during drilling operations, and to adjust a prior risk assessment when actual drilling conditions and drilling system performance have been measured against the expected drilling conditions and predicted drilling system performance.

It would be further advantageous to enable a well planning method able to identify difficult-to-drill sections of the wellbore. Such may permit the selection or design of a drilling system configuration, or a combination of drilling system configurations, as well as a plan of drilling control parameters, to arrive at a solution that is robust to variations in drilling conditions within the formation, and/or which has a reduced risk of failure.

SUMMARY OF THE INVENTION

According to a first aspect of the present invention, there is provided a method for assessing risk associated with drilling a section of a wellbore in a formation using a drilling system, comprising: providing a probabilistic model for the risk of the drilling system triggering a failure mode during drilling; and assessing the risk of the drilling system triggering one of said failure modes during drilling of the section based on said model.

In one embodiment of the method, assessing the risk of the drilling system triggering one of said failure modes includes determining a value of the instantaneous risk of triggering a failure mode at one or more points along the section of the wellbore. In such an embodiment, assessing the risk of the drilling system triggering one of said failure modes may include determining a value of the instantaneous risk of triggering a failure mode at multiple points along the section of the wellbore, and calculating a value of the section risk as the additive risk of the instantaneous risk values.

According to a second aspect of the present invention, there is provided a method for assessing risk associated with drilling a section of a wellbore in a formation using a drilling system, comprising: defining the critical control parameters for the drilling system; and identifying one or more failure modes of the drilling system associated with each critical control parameter which may arise during drilling the section of the formation.

One embodiment of the method further comprises assessing each critical control parameter to determine the probability of triggering each failure mode associated with that control parameter as the critical control parameter varies.

Each critical control parameter may be assessed for a fixed set of external drilling conditions corresponding to a position along the section of the wellbore. Furthermore, each critical control parameter may be assessed for each of multiple sets of external drilling conditions corresponding to respective multiple positions along the section of the wellbore.

The assessed probability of triggering each failure mode associated with each critical control parameter as the critical control parameter varies may be used to define an operating window for the drilling system.

In these methods, the assessed probability of triggering each failure mode associated with each critical control parameter as the critical control parameter varies may be used to define an operating window for the drilling system at each position along the section of the wellbore.

Embodiments of the method may further comprise determining a width of each operating window for one or more individual critical control parameters.

In certain embodiments, the system has N critical control parameters and the method further comprises determining an N-dimensional volume corresponding to the size of each operating window.

The method may further comprise plotting the instantaneous operating point of the system, corresponding to the instantaneous value of each of the critical control parameters, within each respective operating window or the N-dimensional volume, respectively.

Embodiments of the method further comprise assessing whether the drilling system is robust to variation of the external drilling conditions throughout drilling of the section of the wellbore.

In further embodiments of the method, the assessed probability of triggering each failure mode associated with each critical control parameter as the critical control parameter varies is used to determine a value of the risk of the drilling system failing if it is used for drilling the section of the wellbore.

The method may further comprise determining a value of the instantaneous risk of the drilling system failing at each point along the section of the wellbore. Here, the method may further comprise determining a value of the risk of the drilling system failing if it is used for drilling the section of the wellbore as a whole by summing the values of the instantaneous risk at substantially every point along the section of the wellbore. Such embodiments of the method may further comprise determining a value of the risk of the drilling system failing if it is used for drilling the section of the wellbore as a whole by calculating the scalar product of a unitary matrix representative of the drilling system, or of multiple candidate drilling systems including said drilling system, with a risk matrix representative of the instantaneous risk of any one of the failure modes arising in the or each drilling system configuration as multiple critical control parameters are varied at substantially every point along the section of the wellbore.

In embodiments of the method, assessing each critical control parameter may be done by simulating or otherwise mathematically modeling drilling the section of the wellbore with the drilling system, or by measuring the effect of varying the critical control parameters during an actual drilling operation using the drilling system, or by a combination of these.

In the embodiments of the invention, the critical control parameters may be independent control parameters for conducting drilling of the section of the wellbore with the drilling system.

According to a third aspect of the present invention, there is provided a method for selecting a drilling system for drilling a section of a wellbore in a formation, comprising: identifying two or more candidate systems available for selection; assessing risk associated with drilling the section of the wellbore using each candidate drilling system according to a method of the first or second aspect; and selecting the drilling system with which to drill the section of the wellbore based at least in part on the respective assessed risk for each candidate system.

Embodiments of the method may further comprise eliminating from selection any candidate systems determined not to be robust to variation of the external drilling conditions throughout drilling of the section of the wellbore.

According to a fourth aspect of the present invention, there is provided a method for optimizing the performance of a drilling system for drilling a section of a wellbore comprising: assessing risk associated with drilling the section of the wellbore using the drilling system according to a method of the first or second aspect; and adjusting the drilling system configuration and/or control parameters for the drilling system to maximize or maintain at least one performance characteristic whilst minimizing, reducing or capping risk.

According to a fifth aspect of the present invention, there is provided a method for planning a well drilling operation comprising drilling a section of a wellbore in a formation using a drilling system, the method comprising: assessing risk associated with drilling the section of the wellbore using the drilling system according to the method of the second aspect; and selecting planned values for the critical control parameters for the system throughout the section of the wellbore which are predicted not to trigger any of the failure modes of the drilling system associated with each critical control parameter.

According to a sixth aspect of the present invention, there is provided a method for drilling a wellbore in a formation using a drilling system, comprising: drilling at least part of the wellbore with the drilling system; and assessing risk associated with drilling a future section of the wellbore using the drilling system according to the method of the first or second aspect.

Embodiments of the method include: assessing risk associated with drilling the wellbore based on a predicted performance of the drilling system; and determining the actual performance of the drilling system in drilling the at least part of the wellbore, wherein said assessing risk associated with drilling a future section of the wellbore is based on a predicted future performance of the drilling system based at least in part on said determination of the actual drilling performance.

Assessing risk associated with drilling a future section of the wellbore may be done during drilling of the wellbore.

According to a seventh aspect of the present invention, there is provided a method for assessing the ability of a drilling system to drill a section of a wellbore without triggering a failure mode of the drilling system, comprising: providing a probabilistic model for the risk of the drilling system triggering a failure mode during drilling under the variation of one or more critical control parameters; and identifying upper and/or lower threshold values for each control parameter, at one or more points along the section of the wellbore to be drilled, respectively above or below which thresholds the risk of a failure mode of the drilling system being triggered is deemed to be unacceptable.

Embodiments of the method further comprise defining an operation window for the drilling system at the or each point as being the range of values for each control parameter within which the risk of a failure mode of the drilling system being triggered is deemed to be acceptable. Embodiments of the method may further comprise determining whether the drilling system is robust to variations in the drilling conditions during drilling of the section by testing whether any single set of values of the control parameters can be used continuously throughout drilling of the section whilst remaining within the operating window at every point.

Embodiments of the method may comprise identifying any points for which there is no available operating window due to every available value of one or more of the control parameters being above the respective upper threshold or below the respective lower threshold. These embodiments may further comprise defining one or more transition points adjacent to any points having no available operating window, identifying upper and/or lower threshold values for each control parameter, at each transition point, respectively above or below which thresholds the risk of a failure mode of the drilling system being triggered is deemed to be unacceptable, and defining an operation window for the drilling system at each transition point as being the range of values for each control parameter within which the risk of a failure mode of the drilling system being triggered is deemed to be acceptable.

Embodiments of the method may further comprise dividing the section into two or more parts and re-assessing the ability to drill the section of a wellbore by using a first drilling system for a part of the section including a point at which no operating window was available and using a second drilling system for at least part of the section for which every point had an available operating window. These embodiments may further comprise determining whether the first and second drilling systems are robust to variations in the drilling conditions during drilling of the respective parts of the section by testing whether any single set of values of the control parameters can be used continuously throughout drilling of the respective part whilst remaining within an available operating window at every point.

The method of any one of the aspects may be a software-implemented method.

Similarly, the method may be a computerized method, carried out using a programmed computer.

According to an eighth aspect of the present invention, there is provided a computer arranged to carry out the method of any of the first to seventh aspects.

According to a ninth aspect of the present invention, there is provided a computer-readable medium having stored thereon programming code which is arranged, when run on a computer, to implement a method according one of the first to seventh aspects.

According to a tenth aspect of the present invention, there is provided a drilling system arranged to perform the method according to the sixth aspect.

The drilling system may comprise a CPU arranged in a downhole tool of the drilling system to perform said method.

BRIEF DESCRIPTION OF THE DRAWINGS

To enable a better understanding of the present invention, and to show how the same may be carried into effect, reference will now be made, by way of example only, to the accompanying drawings, in which:—

DETAILED DESCRIPTION

Figure 1B:
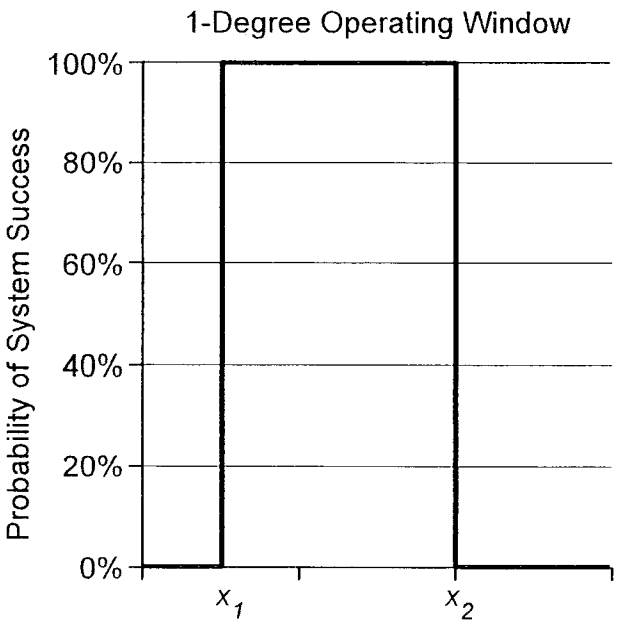
FIGS. 1A and 1B show the probability distribution for the Operating Window of a drilling system between two failure modes as the critical control parameter x is varied, and the corresponding inverse function showing the probability of success in the same Operating Window.

Embodiments of the present invention can provide methods by which to evaluate the risks of failure (and therefore associated non-productive time) for a drilling system drilling a section of a wellbore. The risk of failure for the drilling system may be expressed as a risk index. The risk of failure may be determined based on the risk of triggering one or more failure modes of the drilling system. The risk may be calculated as the instantaneous risk of triggering any failure mode at a particular point along the planned section of the wellbore, and a section risk may be calculated as the additive risk across all points along the section. Conversely, the risk index may be derived from consideration of the operating window for the system, within which no failure will occur, or within which the risk of failure is at an acceptably low level.

One technique is disclosed and discussed herein in general theoretical terms, but may be applied widely to the evaluation of risk in any number of different specific drilling operations. The technique is based on developing a mathematical model of a drilling system S which may be subject to $F=(f_1, \ldots, f_N)$ different failure modes. The system is controlled, within the system's physical limits, by setting or controlling one or more critical control parameters $X=(x_1, \ldots, x_L)$. The drilling environment, such as the formation properties, defines the external conditions $C=(c_1 \ldots c_M)$ to which the system S is subjected during drilling of the section of interest, and over which the drilling system operator has no direct control.

In the exemplary method which is described herein, the failure behaviour of the drilling system is described mathematically using a multidimensional set of probabilistic distributions $P=P_F(S,X,C)$ to describe the risk of any one of the failure modes F occurring when the drilling system S is subjected to external conditions C as the critical control parameter X varies.

Specific details of the mathematical risk model will now be described. To assist in understanding the description which follows, the following notation and relationships will be used herein:

$P_i(S, x, \sigma)$: Probability that at the chosen value x of the critical parameter, i-th type of failure will occur for the Mechanical system S, subject to external conditions σ.

$R_i(S, x, \sigma)$: Probability that at the chosen value x of the critical parameter i-th type of failure will not occur for the mechanical system S, subjected to external conditions σ.

$P_i(S, x, \sigma)+R_i(S, x, \sigma)=1$: the system can only fail or not fail for each value of critical parameter x.

$\theta(a-x)\times\theta(x-b)=0$, $a\leq b$: this relationship is easy to demonstrate, as for each value of x one of the two members is zero.

$\theta(x-a)\times\theta(x-b)=\theta(x-\max(a, b))$: this relationship is easy to demonstrate as the product is equal to 1 for each $x\leq\max(a, b)$, and 0 otherwise.

$\theta(a-x)\times\theta(b-x)=\theta(\min(a, b)-x)$: this relationship is easy to demonstrate as the product is equal to 1 only when $x\leq\min(a, b)$.

$\theta(x)\times\theta(x)=\theta(x)$: this relationship is self evident.

$OP_{ij}(S, \sigma)\equiv\int R_{ij}(S, x, \sigma)dx$: when x is chosen within the Operation Window such that, as described further below, the system is not subject to either failure mode i or j.

If T is a matrix (m rows)×(n columns) and S is a matrix (m rows)×(n columns) then the Scalar Product of the two matrices is:

$$T\cdot S=\sum_{i=1}^{m}\sum_{j=1}^{n} t_{ij}\cdot s_{ij}=t_{11}\cdot s_{11}+t_{12}\cdot s_{12}+\ldots+t_{mn}\cdot s_{mn}$$

Operating Window

The concept of a system having an Operating Window has been explored in other fields, notably in the field of manufacturing, for example by Clausing and Taguchi (see D. P. Clausing, "Total quality developmemt", ASME Press, New York (1994); D. P. Clausing, "Operating window—an engineering measure for robustness", Technometrics 46(1) (2004); and G. Taguchi, "Taguchi on robust technology development", ASME Press, New York (1993); these papers are incorporated herein by reference in their entirety).

Herein, we define an Operating Window as follows:

> "The Operating Window [of a physical system] is defined as the boundaries of a critical parameter at which certain failure modes are excited".

For a drilling system, the critical control parameters are parameters that the drilling operator can set or control; The critical control parameters are independent control parameters, and include all the independent control parameters which together fully determine the operational state of the drilling system from a failure perspective.

The critical control parameters may vary as between different drilling systems, and depending on the type of drilling operation being performed. By way of example, for a typical drilling operation, three critical control parameters can be adjusted to excite failure modes in the drilling system: weight on system, rotary speed, and flow rate.

In this case, one can, at least theoretically, find precise thresholds defining the operating window of a drilling system S using the three critical parameters. For instance, if the weight on system is so low that the drill bit will not engage the rock then ROP (rate of penetration) will be zero and detrimental vibration modes may be excited. Conversely, at high weight on system the cutters may become over-engaged, which may lead to them becoming overloaded and damaged.

Similar thresholds can be identified for the rotary speed (RPM) and flow rate, through the specification of the system behavior and failure modes associated with variation of these control parameters. For example, the drilling system may fail due to an increase in lateral vibration beyond an acceptable limit, or due to poor cleaning of the hole, washout or losses.

In this connection, it may be noted that the term "failure" is intended to include any cause of the drilling system failing to drill through the formation, and as such encompasses any failure in drilling functionality. Where drill bit failure is concerned, the failure mode may be associated with impact damage to the bit teeth or cutters, whilst, in the case of a downhole tool, the tool may become damaged by vibration and environmental conditions. These types of failure might be termed as catastrophic or terminal failure modes, as the component in question would likely need to be retrieved and replaced in order to proceed further with the drilling operation. In general, a drilling system should be designed or selected with very low tolerance to any risk of this type of failure. On the other hand, other failure modes may be classified as non-catastrophic or non-terminal, as the failure represents merely an inability of the drilling system to proceed further with the intended drilling operation, but not a mechanical failure or destruction of part of the system itself. In the following example, no distinction is made between these different types of failure mode, as the analysis is concerned with overall drilling system functionality regardless of the failure mode type. Nevertheless, if a high risk drilling condition is identified in a section of a wellbore which it is planned to drill, it may be informative to investigate further which failure mode(s) are predicted to cause the drilling system to fail.

In one method, the operating window is determined, for the drilling system to be assessed, at multiple points along the section to be drilled. The operating window for the drilling system is determined at each point along the section based on the predicted external drilling conditions. The external drilling conditions are the properties of the drilling environment which affect the failure modes to which the system is susceptible. In many cases, as in the example which follows, the external drilling conditions may be adequately defined by one or more formation properties, such as the compressive rock strength $\sigma$. Additional factors relating to the drilling environment and which may affect the risk of failure include the density of the drilling mud, which can affect the confined rock strength, and the hole stability.

Before generalizing the concept to three or more dimensions (i.e., three or more independent critical control parameters), it is helpful to consider the case of a system S controlled exclusively by one critical control parameter x. In this example, weight on system is taken as the critical control parameter, with the system being susceptible to the above-noted failure modes of the drill bit not engaging with the formation when the weight on system is too low, and of the cutters over-engaging and becoming damaged when the weight on system is too high. The associated failure modes for the critical control parameter x are triggered when the control parameter rises above an upper threshold value, $x_2$, or falls below a lower threshold value, $x_1$. In this case, it is easy to mathematically model the probability that the system will be subjected to either one of the associated failure modes, as this depends solely on the value of the critical control parameter x:

$$P_{12}(x) = \theta(x_1 - x) + \theta(x - x_2), \quad x_1 < x_2 \tag{1}$$

Where

-continued $$\theta(x) = \begin{cases} 0 & \text{if } x \le 0 \\ 1 & \text{if } x > 0 \end{cases} \tag{2}$$

Figure 1A:
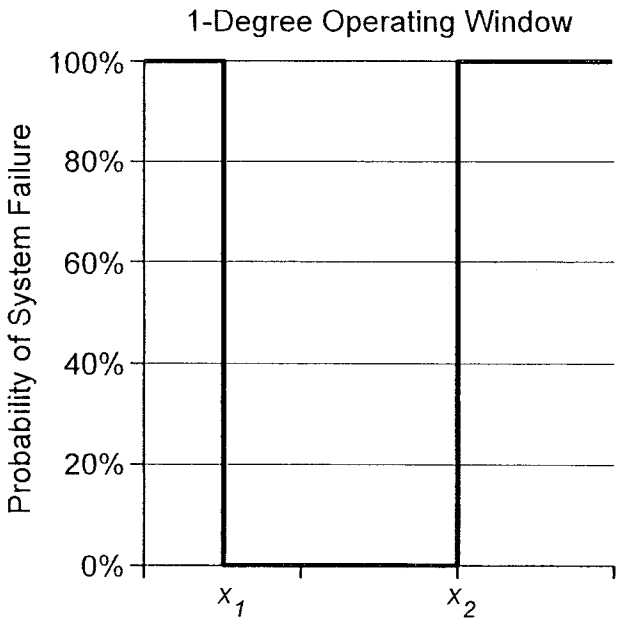
Figure 2A:
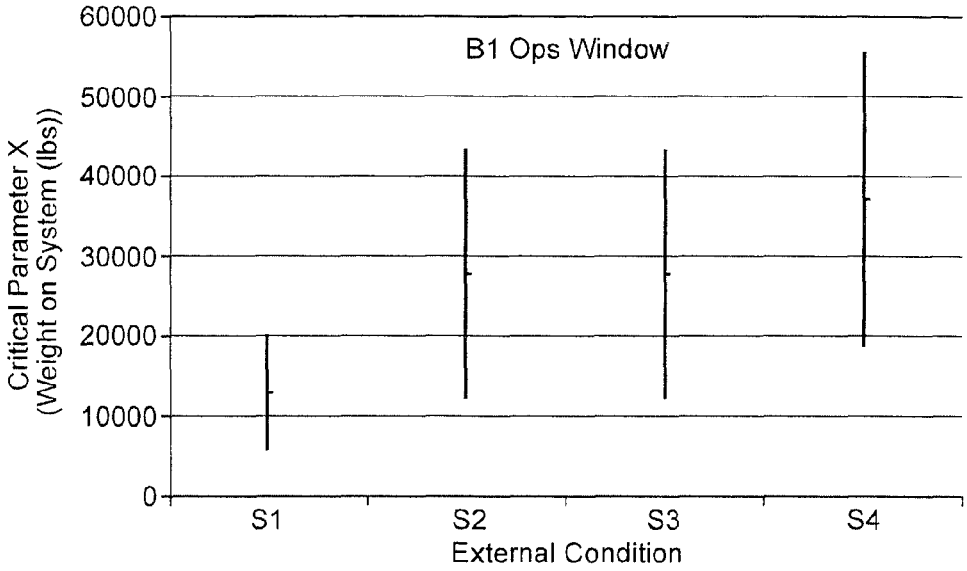
FIGS. 2A to 2D show the Operating Windows for each of four candidate drilling systems for multiple external drilling conditions.
Figure 2B:
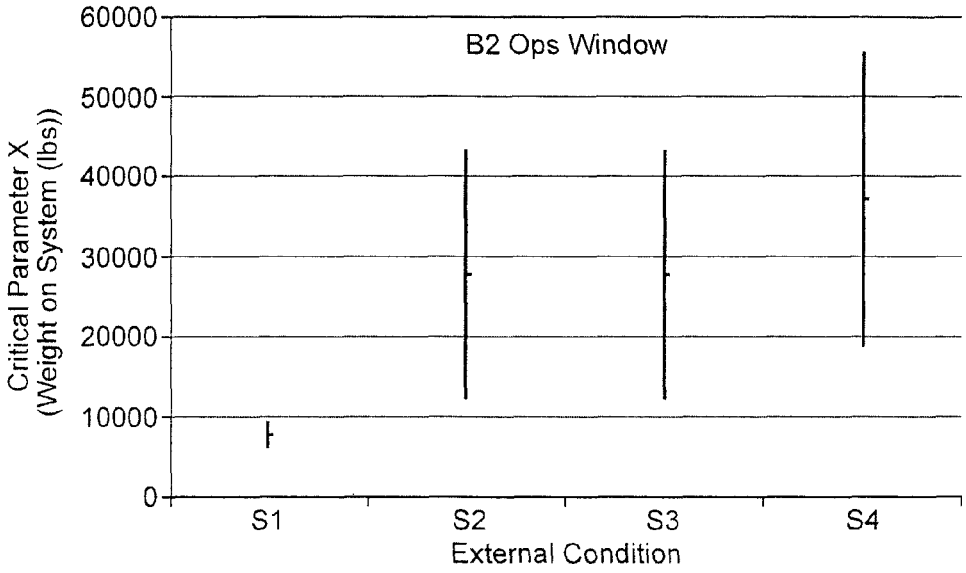
Figure 2C:
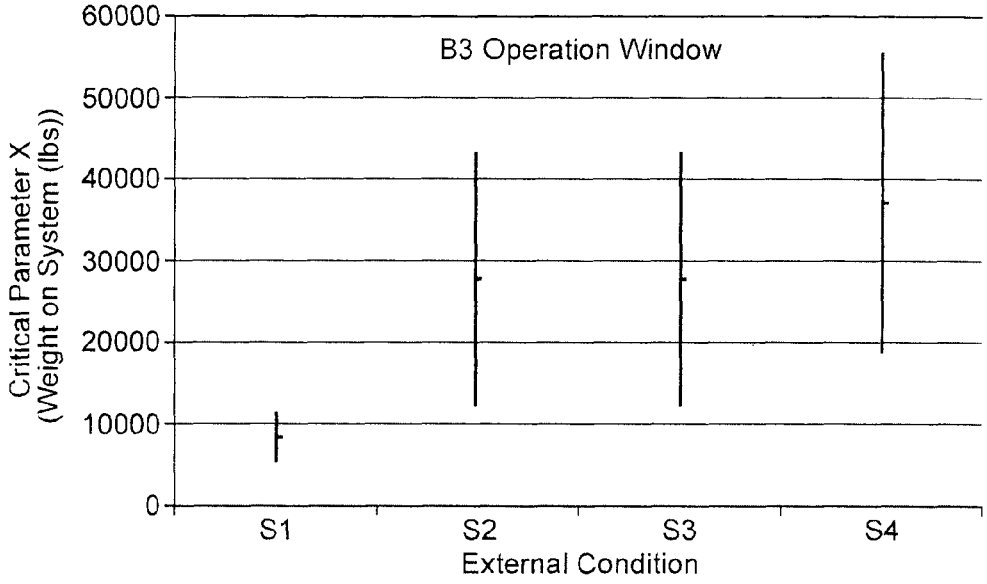
Figure 2D:
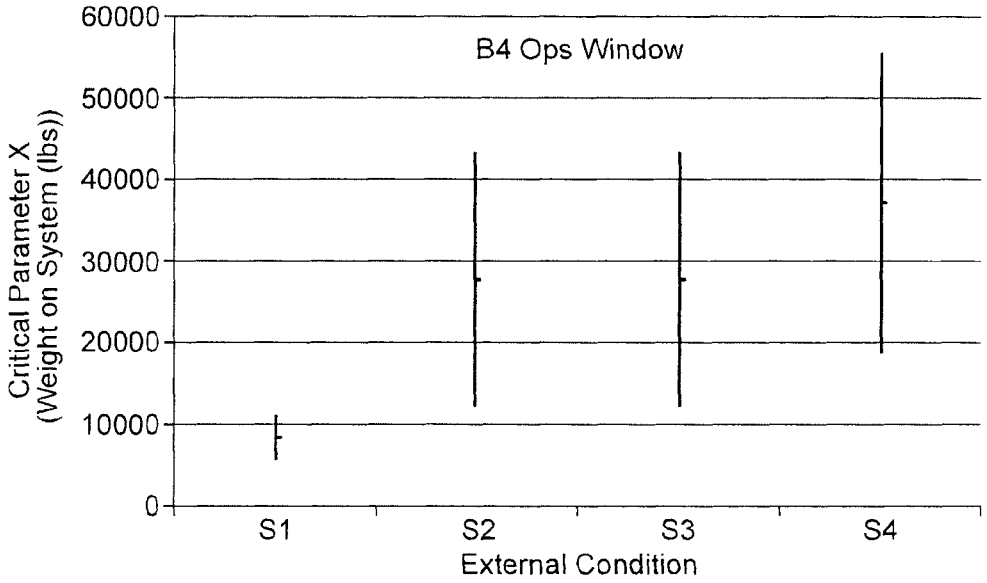

This probability function is represented graphically in FIG. 1A. It is worth noting that, for certain failure modes, the probability distribution need not be expressed as a step function, but may be in the form of a Gaussian distribution, for example. In this case, it may be desirable to define upper and lower thresholds for the value of x which define the operating window as being the region within which the probability of triggering a failure mode is below a certain percentage, if the drilling operator is willing to accept a degree of risk of triggering a failure mode (for example if this will permit higher drilling system performance, such as increased ROP). Otherwise, the upper and lower thresholds may be set to the bounds of the region of values of x within which the probability of failure is zero, thereby again defining the probability distribution as a step function. For present purposes, the following description assumes that the Operating Window is the region within which the chance of triggering a failure mode is zero.

The inverse of $P_{12}(x)$ is the function $R_{12}(x)=1-P_{12}(x)$. This inverse function is shown graphically in FIG. 1B, and describes the probability of the drilling system not failing, i.e., that neither failure mode 1 nor failure mode 2 will be triggered as x is varied. By definition of the function $P_{12}(x)$, for all values of x within the range from $x_1$ to $x_2$, $\forall x \in (x_1, x_2)$, the probability of exciting either failure mode 1 or failure mode 2 is nil, namely, the probability of success is 1.

It is important to note the assumption relied on here, that the failure modes which occur with variation of the value of the critical control parameter x are independent. In other words, failure mode 2 cannot happen contemporaneously with failure mode 1. The fact that failure mode 2 is initiated at values of x greater than the ones at which failure mode 1 is initiated is merely used for the purpose of maintaining consistent notation; because, in practice, the failure modes are independent, the notation will remain consistent all times. Therefore, in this basic example, the critical control parameter x fully determines the one-dimensional failure behaviour of the system S.

Once the threshold values have been determined, it is possible to calculate the size of the Operating Window between the upper and lower limits $x_1$ and $x_2$. The Operating Window is characterized by the fact that the probability of failure is zero when the parameter x is within the range from $x_1$ to $x_2$, i.e., $x \in (x_1, x_2)$. Expressed mathematically, this gives the relationship:

$$P_{12}(x)=0, \text{ when } x \in (x_1, x_2) \tag{4}$$

The Operating Window "width" may then be calculated using the distribution $R_{12}$, i.e., the inverse of the probability $P_{12}$, as $$OP_{12}=\int R_{12} \cdot dx=(x_2-x_1) \tag{5}$$

$$R_{12}(S,x,\sigma)=1-[\theta(x_1(S,\sigma)-x)+\theta(x-x_2(S,\sigma))] \tag{3}$$

This relationship will be true as long as the system remains within fixed external conditions. In the case of a drilling system, the above relationship is true if the formation remains truly invariant with depth. Of course, this is not a viable assumption in practice. However, if the external conditions are defined as $\sigma \equiv \sigma(d)$, then it is possible to express the external drilling conditions to which the system S is subjected as a continuous function which varies with parameter d (in the present example, this function represents the unconfined or confined compressive rock strength as a function of depth d).

Relationship (1) can then be generalized because for each value of the external condition σ there is a probability P of failure 1 or failure 2.

$$P_{12}(S,x,\sigma)=\theta(x_1(S,\sigma)-x)+\theta(x-x_2(S,\sigma)),x_1<x_2 \quad (6)$$

Consequently, the Operating Window upper and lower threshold values will also be a function of the parameter d. Therefore, using relationship (3), the width of the Operating Window of the system S is given by:

$$OP_{12}(S,\sigma)\int_{x_1(S,\sigma)}^{x_2(S,\sigma)} R_{12}(S,x,\sigma)dx=(x_2(S,\sigma)-x_1(S,\sigma)) \quad (7)$$

Instantaneous Risk and Section Risk

In embodiments of the present invention, the risk of drilling a section of the wellbore may be calculated as a value representing the Section Risk. The Section Risk values calculated for each candidate drilling system may then be compared. In embodiments of the invention, the probabilistic failure model may be constructed so as to calculate the Instantaneous Risk at one or more points along the section of a wellbore to be drilled. The Instantaneous Risk values may be used to calculate, or determine limits for, the Section Risk for each candidate drilling system. The Instantaneous Risk at any point may be calculated based on the determined Operating Window, specifically the width OP of the Operating Window, at that point.

It is reasonable to consider that the width of the Operating Window, OP, and the risk of incurring a failure according to mode 1 or mode 2 are linked each other for a given system S subjected to an external condition σ. For example, for two different bottom hole assembly (BHA) configurations (which will correspond to two different systems) as candidates for drilling the same section of a wellbore in a formation (i.e., under the same external conditions), the one having the largest OP in that formation will exhibit the lowest probability of experiencing a failure according to either mode while varying the critical parameter x.

If we continue with the example of the weight on system as the sole critical control parameter x, a physical experiment consisting in varying the weight and recording when this triggers a failure according to failure mode 1 or mode 2 at each value of the weight on system can be carried out. If one of the two systems has an Operating Window with width OP≈0, then it is extremely probable that the above experiment would record one of the two failure modes at almost any given value for the weight on system that is greater than 0. Conversely if the width OP of the Operating Window is very large, the result would be the opposite (i.e., it is probable that the experiment would not record the triggering of either of the failure modes for almost every value of the weight on system). Of course, with modern software and computing capacity, the physical test may be performed virtually using a computerized drilling simulation.

On this basis, it is possible to define the Instantaneous Risk ($\mathfrak{R}_{12}$ (S, σ)) of either failure mode being triggered as being the inverse of the width OP of the Operating Window calculated for the system S when the external conditions have the value σ, namely:

$$\mathfrak{R}_{12}(S,\sigma)=\frac{1}{OP_{12}(S,\sigma)} \quad (8)$$

Excluding the system wear, risks will be remain additive, because each probability, at the variation of σ, is independent from all of the others. Consequently the risk of triggering any of the failure modes when drilling a section of a wellbore using a drilling system S subjected to the N external conditions $\mathcal{F}\equiv(\sigma_1,\ldots,\sigma_N)$ will be the sum of the values for the Instantaneous Risk calculated for each external condition. Adding a normalizing factor and using equation (7), this gives the Section Risk, $\mathfrak{H}_{12}$(S), as:

$$\begin{aligned}\mathfrak{H}_{12}(S)&=\frac{1}{N}\sum_{i=1}^{N}\frac{1}{OP_{12}(S,\sigma_i)}\\&=\frac{1}{N}\sum_{i=1}^{N}\frac{1}{\int_{x_1(S,\sigma_i)}^{x_2(S,\sigma_i)}dx}\\&=\frac{1}{N}\sum_{i=1}^{N}\frac{1}{x_2(S,\sigma_i)-x_1(S,\sigma_i)}\end{aligned} \quad (9)$$

From (9) it is easy to see that $$\frac{1}{\min_i(x_2(S,\sigma_i)-x_1(S,\sigma_i))}\geq\mathfrak{H}_{12}(S)=\frac{1}{N}\sum_{i=1}^{N}\frac{1}{OP_{12}(S,\sigma_i)}\geq\frac{1}{\max_i(x_2(S,\sigma_i)-x_1(S,\sigma_i))} \quad (10)$$

In other words, the (normalized) Section Risk of a system S is always bounded by the inverse of the largest and the smallest values of the widths OP of the Operating Windows, out of all of the Operating Windows, at the variation of the external condition σ. To simplify the notation, the following relationships can be defined:

$$L(S)=\min_{i=1,\ldots,N}OP_{12}(S,\sigma_i)=x_2(S,\check{\sigma})-x_1(S,\check{\sigma})$$

$$U(S)=\max_{i=1,\ldots,N}OP_{12}(S,\sigma_i)=x_2(S,\tilde{\sigma})-x_1(S,\tilde{\sigma})$$

Then, using the notation from equation (8) for the Instantaneous Risk associated with each of these two values of σ, the lower and upper bounds for Section Risk of the system S can be defined as:

$$\frac{1}{U(S)}=\mathfrak{R}_{12}(S,\tilde{\sigma})\leq\mathfrak{H}_{12}(S)\leq\mathfrak{R}_{12}(S,\check{\sigma})=\frac{1}{L(S)} \quad (11)$$

The above relationship (11) can be used as a quick risk assessment test for a set of candidate drilling systems for drilling through the same set of external condition, i.e., the same section of a planned wellbore. In principle, one may then select the candidate drilling system which has least risk of triggering a failure mode by selecting the system with the minimum $\mathfrak{R}_{12}$(S, $\check{\sigma}$) and the maximum $\mathfrak{R}_{12}$(S, $\tilde{\sigma}$). However, a single candidate system may not exhibit both the minimum $\mathfrak{R}_{12}$(S, $\check{\sigma}$) and the maximum $\mathfrak{R}_{12}$(S, $\tilde{\sigma}$) in which case the drilling system S having the predicted least chance of triggering a failure mode during drilling of the section may be selected by choosing the drilling system S that has the smallest section risk among all available candidate systems.

Worked Example 1

In the following worked example, four candidate drilling systems, B1 to B4, having respective different BHAs, which differed only in terms of the bit design used, were used to drill a predefined sequence of formations. In this example, failure mode 1 is defined as the under-engagement failure (i.e., the weight on system is not sufficient to engage the formation), and failure mode 2 is defined as over-engagement failure (i.e., the weight on system is too high and cutters are overloaded). Drilling simulation software was used to determine the Operating Windows of each of the candidate drilling systems. Appropriate drilling simulation software is well known to the skilled person, and any suitable such software may be used in accordance with the present invention.

In the present case, the particular software program used was one which operates in accordance with the principles set forth in U.S. application Ser. No. 12/984,473, titled "REAMER AND BIT INTERACTION MODEL SYSTEM AND METHOD", to Luk Servaes, et al. The particular software used is configured for modeling bit and reamer configurations, and uses cutting structure characteristics curves to calculate the equilibrium between "weight on reamer" and "weight on bit" for a given weight on system, BHA and formation properties (external drilling conditions). The software has an algorithm which determines if the cutting structures are under-engaged or over-engaged, and so can directly model the onset of failure mode 1 and failure mode 2, respectively, in the present example. The software can thus be used to calculate an "instantaneous" Operating Window width (OP) value, from which it becomes possible to extract the Instantaneous Risk at the variation of the external conditions σ, and the Section Risk. Equivalent values can be calculated directly, or otherwise be derived, from other existing drilling simulation software, as appropriate to the drilling operation being modeled and the failure modes to which the system being assessed is susceptible.

In the present example, the Operating Windows for each candidate drilling system are determined by the difference between the minimum and maximum weight on system that each candidate drilling system can sustain in a given formation (given set of external conditions).

TABLE 1

| System | Bit Type (No. of Blades) | Cutters | Chamfer |
|---|---|---|---|
| B1 | 4 | 19 mm | 0.02 |
| B2 | 6 | 13 mm | 0.02 |
| B3 | 8 | 16 mm | 0.01 |
| B4 | 10 | 13 mm | 0.01 |

TABLE 2

| Sigma | Formation | σ | Depth in (m) | Depth out (m) | Drilled Length (m) |
|---|---|---|---|---|---|
| S1 | Soft | 3K | 1200 | 1700 | 500 |
| S2 | Shale | 18K | 1700 | 2040 | 340 |
| S3 | Limestone | 25K | 2040 | 3040 | 1000 |
| S4 | Hard | 35K | 3040 | 3540 | 500 |

The drilling simulation software provided performance data and allowed calculation of the Operating Window widths for each system, as set out in the tables below.

TABLE 3

| System | Sigma | X1 | X2 | OP |
|---|---|---|---|---|
| B1 | S1 | 6,126 | 20,126 | 14,000 |
| B1 | S2 | 12,251 | 42,874 | 30,623 |
| B1 | S3 | 12,251 | 42,874 | 30,623 |
| B1 | S4 | 18,376 | 55,124 | 36,748 |

TABLE 4

| System | Sigma | X1 | X2 | OP |
|---|---|---|---|---|
| B2 | S1 | 6,126 | 9,354 | 3,228 |
| B2 | S2 | 12,251 | 42,874 | 30,623 |
| B2 | S3 | 12,251 | 42,874 | 30,623 |
| B2 | S4 | 18,376 | 55,124 | 36,748 |

TABLE 5

| System | Sigma | X1 | X2 | OP |
|---|---|---|---|---|
| B3 | S1 | 6,126 | 11,118 | 4,992 |
| B3 | S2 | 12,251 | 42,874 | 30,623 |
| B3 | S3 | 12,251 | 42,874 | 30,623 |
| B3 | S4 | 18,376 | 55,124 | 36,748 |

TABLE 6

| System | Sigma | X1 | X2 | OP |
|---|---|---|---|---|
| B4 | S1 | 6,126 | 11,143 | 5,017 |
| B4 | S2 | 12,251 | 42,874 | 30,623 |
| B4 | S3 | 12,251 | 42,874 | 30,623 |
| B4 | S4 | 18,376 | 55,124 | 36,748 |

These results are presented graphically in FIGS. 2A to 2D, to show the Operating Windows for each drilling system B1 to B4 for each external drilling condition S1 to S4.

The Section Risk is then calculated for each candidate drilling system B1 to B4 to give a Risk Index or Section Risk Table (a scaling factor $10^5$ is here used to represent the data):

TABLE 7

| System | Section Risk | $\frac{1}{U(S)} = \Re_{12}(S, \check{\sigma})$ | $\Re_{12}(S, \check{\sigma}) = \frac{1}{L(S)}$ |
|---|---|---|---|
| B1 | 4.1 | 2.7 | 7.1 |
| B2 | 10.0 | 2.7 | 31.0 |
| B3 | 6.7 | 2.7 | 17.6 |
| B4 | 7.3 | 2.7 | 19.9 |

From this analysis, it becomes apparent that the lowest risk drilling system to run for the given section of the wellbore to be drilled is candidate drilling system B1. This drilling system has the largest minimum Operating Window (L(S)) and as such has the lowest associated risk among all candidate systems of triggering a failure mode during drilling of the section of the wellbore. It can also be seen that this drilling system permits the smoothest transition between the successive divisions of the section of the wellbore described by respective formation characteristics S1 to S4. Specifically, with reference to FIG. 2A, it can be seen that a single value of the critical parameter x (weight on system) can be maintained (at around 20,000 lbs (about 9,072 kg)). For the remaining candidate drilling systems B2 to B4, it is necessary to change the weight on system when transitioning from one division to the next, in particular from condition S1 to condition S2, in order to remain within the operating window for each division.

Robustness

Methods in accordance with the present invention may also or alternatively be used to investigate the robustness of a drilling system to changes in the drilling environment (external drilling conditions).

A drilling system $S_0$, which does not change with the variation of the external drilling conditions σ, may be described as being robust to variations in the external drilling conditions σ, for the section of the wellbore to be drilled, if the critical control parameter x can be kept at a constant, fixed value throughout the drilling operation whilst remaining within the Operating Window at every point along the section of the wellbore to be drilled.

Such a system may be described as being σ-robust. Mathematically, the system $S_0$ is σ-robust if there exist a range of values for the critical control parameter x, between a lower limit a and an upper limit b, which lies within the Operating Window for all of the point values of the external drilling condition $\sigma_1, \ldots, \sigma_N$ for the entire set $\mathcal{F}$ of the N different external drilling conditions. In mathematical notation, this condition is expressed as:

$$S_0 \text{ is } \sigma\text{–Robust if and only if } \exists \mathcal{M} = [a,b], \text{ with } a<b, \text{ such that } P_{12}(S_0,x,\sigma)=0,\ \forall \sigma \in \mathcal{F}\ \forall x \in \mathcal{M}$$

and the corresponding σ-Robust Operating Window for the entire section is given by:

$$OP_{12}(S_0) = \min_{\sigma\in\mathcal{F}}(x_2(S_0,\sigma)) - \max_{\sigma\in\mathcal{F}}(x_1(S_0,\sigma)) \tag{12}$$

(This can easily be demonstrated by considering that the theorem above implies that the domains $\cap \mathcal{M}_i \neq 0$ for a σ-robust system)

In fact, when $x \in [\max_{\sigma\in\mathcal{F}}(x_1(S_0,\sigma)), \min_{\sigma\in\mathcal{F}}(x_2(S_0,\sigma))]$, $P_{12}(S_0, x, \sigma)=0 \forall \sigma \in \mathcal{F}$ In plain terms, in a drilling environment, relationship (12) implies that the critical control parameter x (in the present example, weight on system) can be chosen within the range from a to b and be kept the same for the entire section without exciting either failure mode 1 (under-engaging cutters with the formation) or failure mode 2 (over-engaging the cutters with the formation).

From a practical point of view, if the drilling operator can keep the critical parameter x within the boundaries a and b, irrespective of the value that a could assume, without triggering failure 1 or 2, then relationship (12) is valid, and the system is σ-robust.

Another way to identify if a drilling system $S_0$ is σ-robust is to verify that $\min_{\sigma\in\mathcal{F}}(x_2(S_0,\sigma)) > \max_{\sigma\in\mathcal{F}}(x_1(S_0,\sigma))$.

Optimization to Maximise Drilling System σ-Robustness

There are interesting optimization algorithms that can be deduced from (12), in the hypothesis that the system response is invariant with σ. To calculate the Optimum σ-robust system S of a collection Ω of σ-robust drilling systems, we can simply maximize equation (12) while varying S.

Maximizing the Operating Window, in this case, is equivalent to maximizing the probability of success (or minimizing the probability of failure); theoretically, if the critical parameter x can be any value from 0 to infinity (the maximum theoretical Operating Window) for a given set of external conditions, the system would never fail when subjected to those external conditions, regardless of the value of the critical parameter x value.

In the real world, the same drilling parameters—critical control variables x—could be used for many drilling systems with different BHA configurations (changing the drill bit only, for instance) to drill the same formations. In this case, the optimum drilling system S is selected from a finite collection Ω of N different candidate drilling systems, $S_1, \ldots, S_N$. If each of the drilling systems $S_1, \ldots, S_N$ is σ-robust, using (12) one can define the width OP of the Operating Window for the i-th σ-robust system in the collection, $S_i$, as $$OP_{12}(S_i) = \min_{\sigma\in\mathcal{F}}(x_2(S_i,\sigma)) - \max_{\sigma\in\mathcal{F}}(x_1(S_i,\sigma))$$

This permits a definition of the drilling system S̃ having the largest Operating Window $\tilde{O}P_{12}$ of $$\widetilde{OP}_{12} = \max_{S\in\Omega} OP_{12}(S_i) = \max(OP_{12}(S_1), \ldots, OP_{12}(S_N)) \tag{13}$$

In simple terms, the drilling system S̃ that satisfies equation (13) is the one having the largest possible range of variation for the parameter x which does not induce failure, whereas external conditions are changed within the entire collection $\mathcal{F}$ representative of the external conditions within the section of the wellbore to be drilled. Put another way, one could say that the system S̃ satisfying equation (13) is the one, among the collection Ω, of σ-robust drilling systems, with the highest chances of successfully drilling the section without exciting either failure mode 1 or failure mode 2—i.e. the one with the lowest associated section risk.

Figure 3:
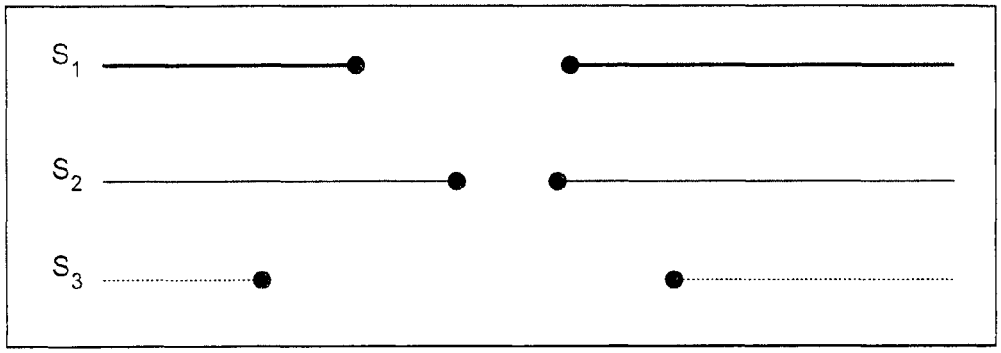
FIG. 3 shows a comparison between the σ-robust Operating Windows for three σ-robust candidate drilling systems.

An example of this is shown schematically in FIG. 3 for three candidate drilling systems S1, S2 and S3, from which it is clear that drilling system S3 has the largest Operating Window, and therefore is the most σ-robust drilling system among the collection Ω=S1, S2, S3, at the variation of a and the critical control parameter x.

The ideal drilling system, from a robustness perspective, is a σ-robust system having $\tilde{O}P_{12}$ infinite, because in such circumstances it is practically impossible to generate either of the failure modes 1 or 2, for any value of the critical parameter x>0, which means that the critical parameter can be safely chosen to optimize other system performance, such as rate of penetration or other performance indicators. It is worth nothing that, if any of the candidate drilling systems in the collection is not σ-robust, the relationship (13) is not true, because the Operating Window is not accurately defined by equation (12) for non σ-robust systems.

To generalize the relationship, it is possible to use a metric for σ-robust systems. A system S will be 1-dimensionally robust if it satisfies equation (12) for any value of $\sigma \in \mathcal{F}$. The system will be bi-dimensionally robust if there exist two subsets $\mathcal{F}_1$ and $\mathcal{F}_2$ of the collection $\mathcal{F}$ such that $\mathcal{F}_1 \cup \mathcal{F}_2 = \mathcal{F}$ and $\mathcal{F}_1 \cap \mathcal{F}_2 = 0$ and equation (12) is satisfied for each subset separately. Extrapolating this relationship, then, in general, a system $S_0$ is N-dimensionally robust if it satisfies the condition:

$$\exists \mathcal{F}_1, \ldots, \mathcal{F}_N \text{ with } \mathcal{F}_i \subset \mathcal{F} \text{ and } \cup \mathcal{F}_i \subset \mathcal{F}, \bigcap \mathcal{F}_i = 0 \tag{14}$$

such that

-continued $$\min_{\sigma \in \mathcal{F}_i} (x_2(S_0, \sigma)) > \max_{\sigma \in \mathcal{F}_i} (x_1(S_0, \sigma))$$

It should be noted that variation of a moves the system across robustness dimension order.

Non σ-Robust Drilling Systems

There are cases in drilling applications (for example, in certain bit-and-reamer combinations) where the failure mode 1 and failure mode 2 are both expected to happen at values of the critical control parameter x that do not respect the condition $x_2 > x_1$. In other words, there is no value for the weight on system that would allow the bit and, in this example, the reamer to contemporaneously engage correctly with the formation. In other words, there is no available Operating Window. According to the risk model described above, then the predicted risk of failure in this condition has probability 1 of happening, which means that the risk of failure is extremely high for this system (theoretically, infinitely high) such that one or both of the two failure modes is essentially guaranteed to occur.

Physically, this may represent a clear example of incompatibility between the selected bit and reamer. However, it is worth considering the matter in more detail. In general, if the drilling operator's attitude to risk taking behavior is adverse, then choosing an incompatible configuration is not a good idea. Such choices are inherently "riskier" than solutions which are σ-robust. However, it may be that the non σ-robust drilling systems are also the ones that are predicted to deliver the best theoretical performance for drilling the section of the wellbore, such as the highest ROP; i.e., they may offer better drilling performance than the σ-robust systems. If this is the case, having a methodology to assess the risk vs. drilling performance, e.g., a measure of the risk to ROP ratio, could be extremely useful for the optimization process and to assist the drilling operator in making an informed selection of which drilling system to use.

Worked Example 2

Figure 4A:
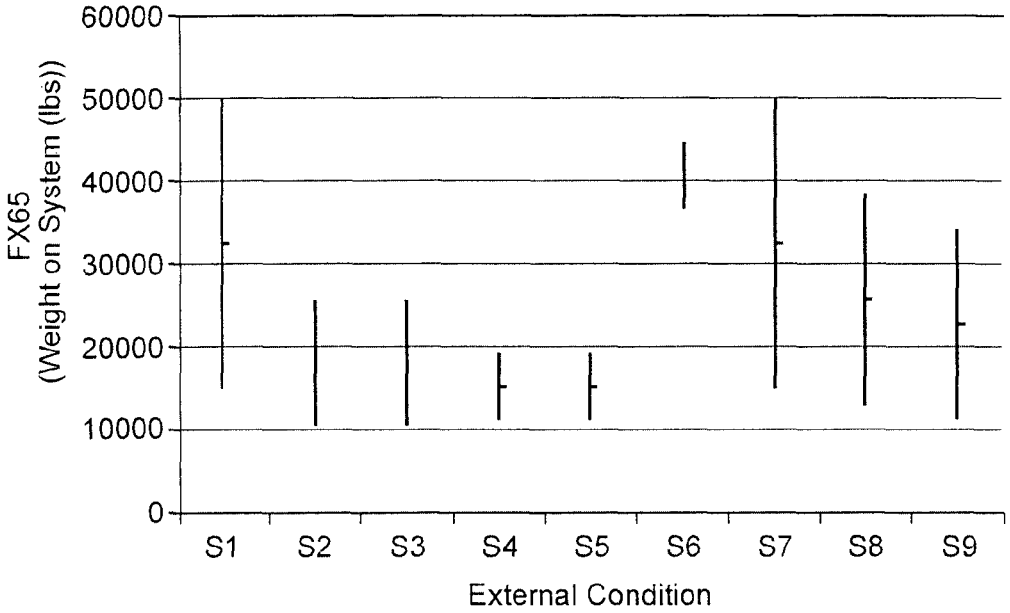
FIGS. 4A and 4B show the calculated Operating Windows for two drilling systems used in actual drilling operations.

A worked example will now be described with reference to FIGS. 4A and 4B. This example is based on two drilling systems, labeled as FX75 and FX65, which were used in real operations involving drilling while simultaneously enlarging the wellbore. Operating Windows for each drilling system were determined at the variation of the external conditions n, as shown respectively in FIGS. 4A and 4B.

Figure 4B:
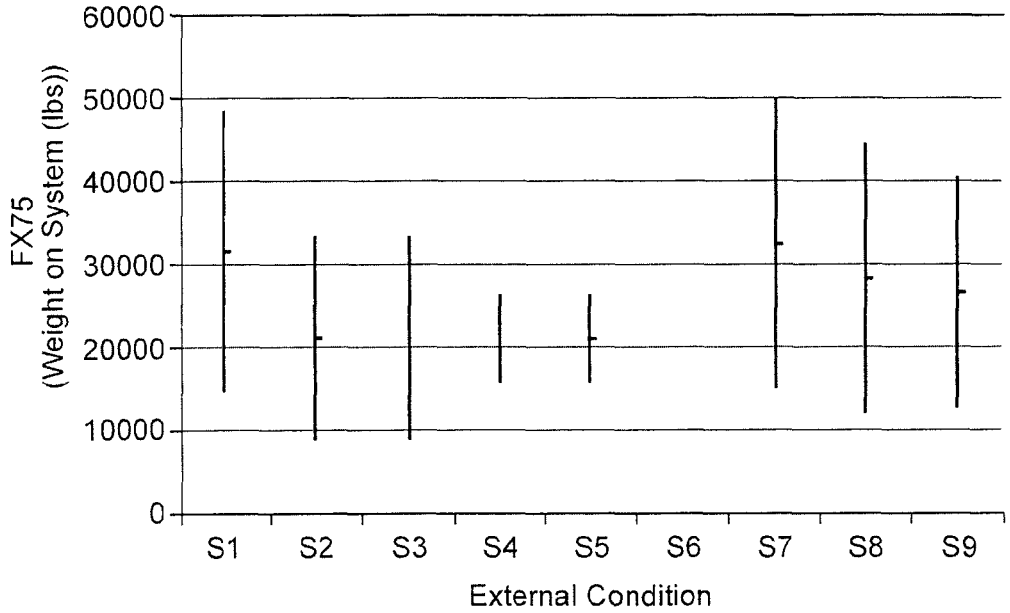

As is shown in FIG. 4B, the FX75 drilling system does not have an Operating Window for the external condition S6. In principle, therefore, one could immediately discount the FX75 drilling system from further consideration as a candidate drilling system. However, if this value is isolated from the analysis and the risk model is run only against the remaining values of the external conditions, then the results given in Table 8, below, are obtained.

TABLE 8

| Configuration | Section Risk (excluding S6) | S6 Instantaneous Risk | Is Sigma-Robust |
|---|---|---|---|
| FX75 12¼ × 14 | 4.87 | Infinite | NO |
| FX65 12¼ × 14 | 6.66 | 12.34 | NO |

The indications are therefore that, in every other scenario of external conditions, the FX65 drilling system configuration is riskier than the FX75 drilling configuration (almost 27% riskier), but that the FX75 drilling system configuration is unable to drill through external condition S6 without triggering a failure. On the other hand, even the FX65 drilling system runs quite a high risk of triggering a failure mode when transitioning from the external condition S5 to the external conditions S6. Considering the application of the risk model to real-world drilling operations, it can be seen that the critical control parameters x have to be significantly changed in order to move from the Operating window for the external condition S5 to that for the external condition S6 (there is no available value for the critical parameter x in the Operating Window for external condition S5 that is also in the Operating Window for external condition S6). Therefore, even for the FX65 drilling system, crossing the interval between external conditions S5 and S6 is likely to require transitioning through a value of the critical parameter x that will either initiate failure mode 2 in drilling through external condition S5 or failure mode 1 in drilling through external condition S6, before reaching a value of the critical parameter x that is within the Operating Window for S6.

Embodiments of the present invention can address this apparent problem.

According to one method, referring to the example above, the approach is to add a transition between external conditions S5 and S6. The two systems can then be evaluated again to determine the Section Risks and the Operating Windows of the two drilling system configurations in these new scenarios. Although adding transition points may appear to be manipulating the predicted external conditions, and might appear as trick simply to ignore the problematic interval, this is not the case. In fact, the drilling reality is that the external conditions are a continuous function of time (during drilling, the drill bit is penetrating through a continuously changing formation throughout the drilling process), so introducing transition points between the evaluated external conditions S5 and S6 is merely equivalent to increase the sampling frequency of the external conditions around the transition between the corresponding portions of the formation being drilled.

Another approach, which can be used in conjunction with adding transition points, is to investigate the sensitivity of the risk model to small variations in the predicted values of the external drilling conditions at the point of interest. The values for the external conditions used in the model (i.e., in the present example, the formation compressive rock strength value) are in reality not precise numbers, because they are derived from electric logs, or otherwise, and not measured directly. It is therefore appropriate to analyze the behaviour of the drilling system in a neighborhood of the value of the external condition at which the singularity in the risk function is generated. In the present example, external condition S6 generates a singularity point for the FX75 drilling system risk function. It is possible to replace S6 with S6-D and/or S6+D, and to calculate the Instantaneous Risk for the set of external conditions, e.g., [S1, S2, S3, S4, S5, S6−D, S6+D, S7, S8, S9]. Again, although this may appear as a trick to avoid the apparent singularity at S6, it should be appreciated that the risk function is not necessarily a continuous function of the external condition parameter. Consequently, it is appropriate to test the sensitivity of the risk model to the predicted values for the external conditions, in order to reveal whether a small variation of the value of the external condition (in this case, of the compressive rock strength) allows the Instantaneous Risk value to be determined. The value D of the variation in the external condition parameter value depends on the level of accuracy to which the external condition can be predicted.

Figure 5A:
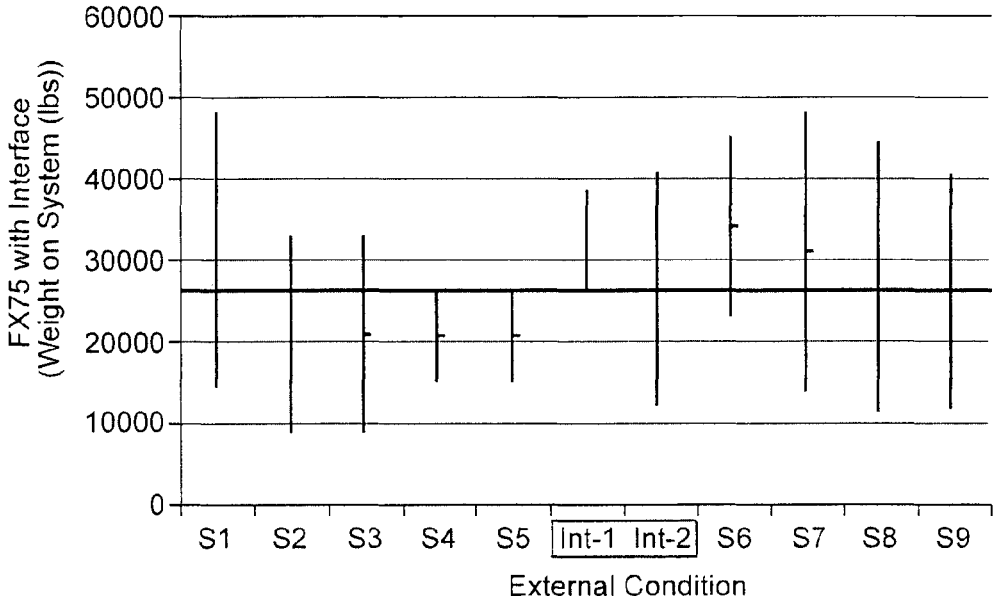
FIGS. 5A and 5B show the re-calculated Operating Windows for the two drilling systems of FIGS. 4A and 4B after further investigation of a singularity in the drilling risk model.
Figure 5B:
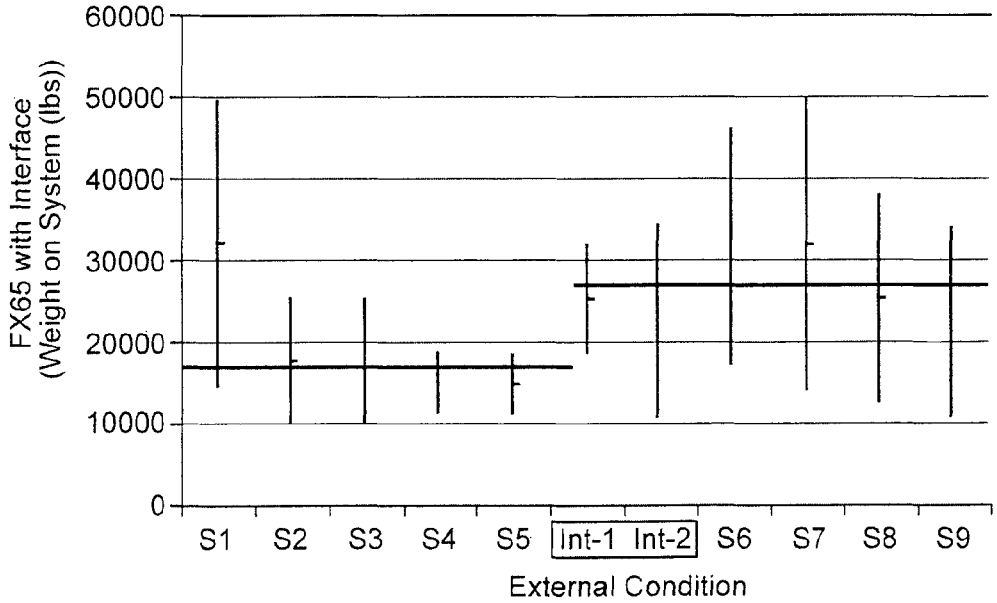

When the risk model is run again, as shown in FIGS. 5A and 5B, after having introduced the transition zone between S5 and S6, in which intermediate points "Int-1" and "Int-2" are evaluated, and having made a small change to the value of the external condition S6 to permit an Instantaneous Risk value to be calculated, the results given in Table 9, below, are obtained.

TABLE 9

| Configuration | Section Risk (with Interface) | S6-D Instantaneous Risk | Is System Sigma-Robust |
|---|---|---|---|
| FX75 12¼ × 14 | 5.01 | 4.55 | YES |
| FX65 12¼ × 14 | 6.62 | 3.48 | NO |

The Section Risks now are compatible: according to the re-calculated values, the FX75 drilling system (corresponding to a 7-bladed bit) is not only a safer option, because the Section Risk is smaller, but also the more detailed investigation reveals that the FX75 drilling system is, in fact, σ-robust throughout the section under investigation (see FIG. 5B).

It can thus be seen how a small variation of the external conditions makes the FX75 configuration σ-robust; this is an important aspect for the optimization of drilling system selection when considering the vicinity of a point of transition between formation types or rock types. Considering that the formation compressive rock strength σ is not known with precision across the interaction, the fact that the drilling system configuration FX75 becomes σ-robust according to the risk model indicates that there is an interval of critical control parameter x (weight on system) values that can be used safely within the transition zone (i.e., in the example, the drilling system can drill through the transition using a constant weight on system).

As an alternative, or following such analysis, and in particular where the singularity in the risk model remains after further investigation, it is possible to split the section to be drilled into two (or more, in case of multiple singularities appearing in the risk model), analyzing each sub-section separately, and then combining the risks together. By definition the risks are additive, and a simple normalization factor can be applied to maintain the risk lower and upper bound equations valid. Such an approach is shown schematically in FIG. 5A for the drilling system FX65 (corresponding to a 6-bladed drill bit). This allows the Section Risk for drilling each sub-section with a different drilling system configuration to be compared directly with the Section Risk for drilling the whole section with one drilling system configuration, for example. It is then possible to compare the two options: multiple drilling systems used to cover sub-sections with different external conditions versus a single drilling system configuration to be used for the whole section of the wellbore for all external drilling conditions.

It will be appreciated that singularity points in the risk function have a very interesting meaning in real terms. The analysis of the singularity points is able to indicate to the analyst:

1) how many drilling systems are necessary to minimize the section risk given knowledge of the formation in which the section of the wellbore is to be drilled; and 2) in the case of multiple drilling systems, the transition point (i.e., the approximate depth) at which the drilling system should be changed in order to avoid a high-risk drilling condition. This has an immediate implication for the drilling operator, who can evaluate the benefits of maintaining a low risk profile versus the cost of tripping the drilling assembly out of hole to change the drill bit or BHA, etc.

Application to Systems with Multiple Critical Control Parameters

In the examples given above, the failure behavior of the system is determined by a single critical control parameter, namely the weight on system. However, the same approach may be used to conduct risk analysis for systems having multiple critical control parameters by which the drilling system is controlled and which determine the failure behavior of the system.

In this regard, it is important to understand that critical control parameters must be independent from each other. In fact if a relationship exists between two or more of a system's control parameters then these do not constitute "critical" control parameters. However, where such a relationship exists, it is nearly always possible to express one control parameter as a function of the other. Consequently, a system having N control parameters, where two of these control parameters are related, can be expressed instead as an equivalent system having (N−1) critical control parameters. The same is true for multiple inter-related (non-critical) control parameters, which, for the purposes of extrapolating the above risk analysis, should be re-written as functions of one another to define N−1, N−2, N−3, and so forth, independent critical control parameters, as appropriate.

The following example assumes that the system under consideration has N independent critical control parameters which uniquely determine the state of the system S as being "failed" or "not failed". The state of the system is thus represented uniquely by a vector $X \equiv (x_1, \ldots, x_N) \in R^N$ space. The relationship given by equation (6) above is therefore a function $R^N \rightarrow R$ that provides the probability that the system S will trigger either failure mode 1 or failure mode 2 as the control parameter vector X is varied. To derive the corresponding probability function for a system having multiple critical control parameters, it is important to recognize that the system S fails if any one (or a combination) of the critical control parameters triggers its own respective failure mode.

For example, as mentioned above, in the case of a BHA containing only one drill bit for drilling a certain formation, the system may be defined by three independent control parameters: weight on system (W), rotary speed (RPM), and drilling fluid flow rate (Q). A possible failure mode assessment is described in Table 10 below.

TABLE 10

| Critical parameter | Failure point 1: $^1x_i$ | Failure point 2: $^2x_i$ |
|---|---|---|
| W | $^1$W = not enough to shear/destroy formation | $^2$W = cutting structure is overloaded |
| RPM | $^1$RPM = first natural frequency for the BHA is excited | $^2$RPM = second natural frequency for the BHA is excited |
| Q | $^1$Q = not enough to clean hole | $^2$Q = Flow rate causes formation damages |

In the case of systems having multiple critical control parameters, it is normally easier to derive the function $R_{12}(S, X, \sigma)$: $R^N \rightarrow R$, and then to use the relationship defined in equation (3) to calculate $P_{12}(S, X, \sigma)$: $R^N \rightarrow R$. For conciseness, the following notation will be used:

${}^1x_i$≡value of the $i^{th}$ critical parameter which triggers its respective failure mode 1

${}^2x_i$≡value of the $i^{th}$ critical parameter which triggers its respective failure mode 2

It is then possible to consider the system S, subjected to an external condition σ, and uniquely characterized by the vector $X\equiv(x_1, \ldots, x_N)\epsilon R^N$ of independent critical parameters. It can clearly be seen from the foregoing that the probability of not triggering any of the failure modes for the system is formally described by the relationship:

$$R_{12}(S, X, \sigma) = \prod_{i=1}^{N} [1 - \theta({}^1x_i\ (S, \sigma) - x_i) - \theta(x_i - {}^2x_i\ (S, \sigma))] \tag{15}$$

Where the operator Π indicates that the product of the inverse function $R_{12}(S, x_i, \sigma)$ of each and every critical parameter must be calculated.

Thus, by way of example, in a system S controlled only by two (independent) critical parameters, $x_1$=W and $x_2$=RPM, the critical control parameter vector X≡(W,RPM). For this system S, with the external conditions defined by the drilling environment, equation (15) becomes:

$$\begin{aligned} R_{12}(S, X, \sigma) &= [1 - \theta({}^1x_1 - x_1) - \theta(x_1 - {}^2x_1)]\cdot \\ &\quad [1 - \theta({}^1x_2 - x_2) - \theta(x_2 - {}^2x_2)] \\ &= [1 - \theta({}^1W - W) - \theta(W - {}^2W)]\cdot \\ &\quad [1 - \theta({}^1RPM - R) - \theta(R - {}^2RPM)] \end{aligned}$$

The above equation is easy to represent graphically; it gives a value of 1 in a specific range of values for X (i.e., for W and RPM), and a value of zero everywhere else, as seen also from Table 11 below.

TABLE 11

| $R_{12}(S, X, \sigma)$ is equal to: | $W < {}^1W \le {}^2W$ | ${}^1W \le W \le {}^2W$ | $W > {}^2W \ge {}^1W$ |
|---|---|---|---|
| $RPM < {}^1RPM \le {}^2RPM$ | 0 | 0 | 0 |
| ${}^1RPM \le RPM \le {}^2RPM$ | 0 | 1 | 0 |
| $RPM > {}^2RPM \ge {}^1RPM$ | 0 | 0 | 0 |

Figure 6:
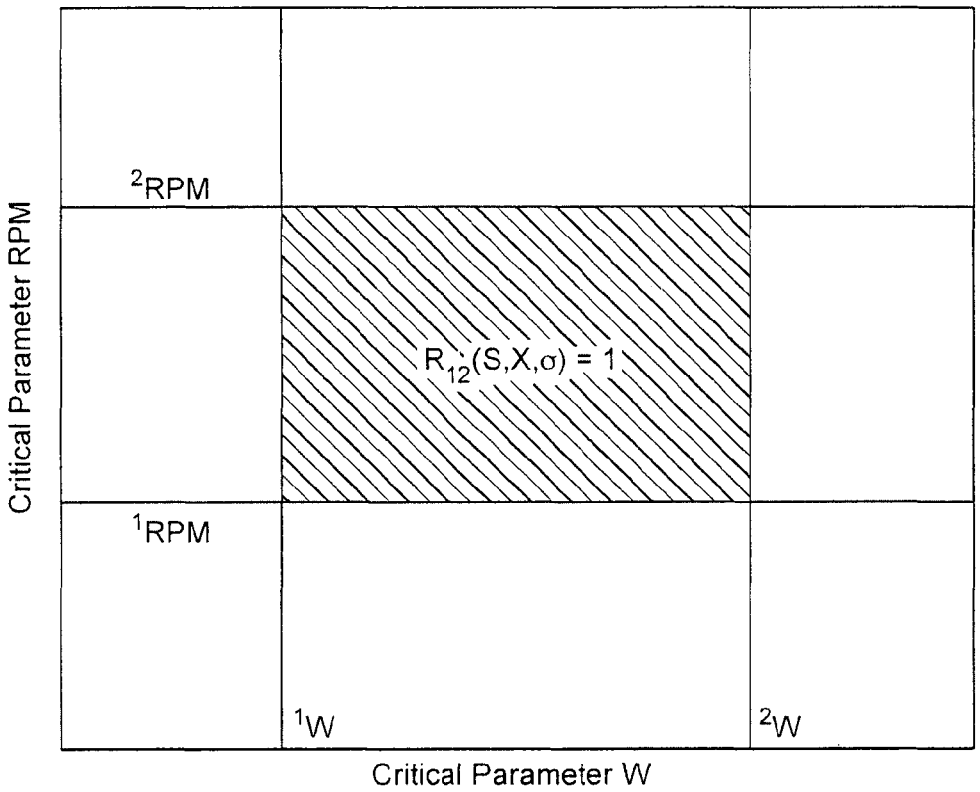
FIG. 6 shows a bi-dimensional chart illustrating the Operating Window for a system controlled by two critical control parameters, W and R.

As shown in FIG. 6, an easy way to represent the above function is to use a bi-dimensional chart in which the shaded area denotes where the function assumes the value 1, and the white (or non-shaded) area denotes where the function assumes the value 0.

As noted above, the function $P_{12}$ can be derived from the relationship defined by equation (3). It will be appreciated that the multiple critical control parameter probability function P is not a simple product of the probability functions for each of the individual single critical control parameter components. This is due to the fact that the system S assumes the status of having failed when any single critical control parameter triggers one of the corresponding failure modes. In the case of drilling a wellbore, for instance, if the weight on system is not sufficient to cause the cutting teeth to engage the formation, it is not possible to drill ahead, regardless of the speed at which the drill bit is rotated; therefore the system is in reality in a "failed state".

Using equation (7) and generalizing the function $R_{12}$, described by equation (15), it is possible to derive the size of the Operating Window, the Instantaneous Risk, the Section Risk and all the other properties of the system S, as described above for the case of a single variable, as follows.

Hence, in the general case, equation (7) becomes:

$$OP_{12}(S, \sigma) = \int \prod_{i=1}^{N} [1 - \theta({}^1x_i(S, \sigma) - x_i) - \theta(x_i - {}^2x_i(S, \sigma))]dx_i \tag{16}$$

Furthermore, in the special case where ${}^1x_i$ and ${}^2x_i$ are independent from each other, then equation (16) formally becomes:

$$\begin{aligned} OP_{12}(S, \sigma) &= \prod_{i=1}^{N} \int_{-\infty}^{+\infty} \\ &\quad [1 - \theta({}^1x_i(S, \sigma) - x_i) - \theta(x_i - {}^2x_i(S, \sigma))]\, dx_i \\ &= \prod_{i=1}^{N} [{}^2x_i(S, \sigma) - {}^1x_i(S, \sigma)] \end{aligned} \tag{17}$$

Note that $OP_{12}$ becomes nil if the width of the Operating Window for any of the critical control parameters is zero—this is in line with the definition that the system is considered to be in a failed state if any of the critical control parameters is outside its own Operating Window. The instantaneous risk in the case of a system having multiple critical control parameters is still described formally by equation (8), although the size of the operating window, $OP_{12}$, is in this case calculated by the equation (16) above (and in special cases by (17) above), in place of equation (7).

Using equations (16) and (8), the Section Risk for a multiple critical control parameter system S, subjected to external conditions varying within the sample $\sigma\epsilon\{\sigma_1, \ldots, \sigma_M\}$, may then be expressed as:

$$\begin{aligned} \mathfrak{S}_{12}(S) &= \frac{1}{M}\sum_{i=1}^{M} \frac{1}{OP_{12}(S, \sigma_i)} \\ &= \frac{1}{M}\sum_{i=1}^{M} \frac{1}{\int \prod_{j=1}^{N} \begin{bmatrix} 1 - \theta({}^1x_j(S, \sigma_i) - x_j) - \\ \theta(x_j - {}^2x_j(S, \sigma_i)) \end{bmatrix} dx_j} \end{aligned} \tag{18}$$

Similarly, using (17), it is easy to see the geometrical meaning of the section risk for a multiple critical control parameter system. In fact, the equation for the Section Risk becomes:

$$\begin{aligned} \mathfrak{S}_{12}(S) &= \frac{1}{M}\sum_{i=1}^{M} \frac{1}{OP_{12}(S, \sigma_i)} \\ &= \frac{1}{M}\sum_{i=1}^{M} \frac{1}{\prod_{j=1}^{N} ({}^2x_j(S, \sigma_i) - {}^1x_j(S, \sigma_i))} \end{aligned} \tag{19}$$

Although involving a more complex calculation, the Section Risk is still a unique function of the system S, and it is equivalent to the normalized sum of once over the volume of each of the hyper-cubes representing the size of the Operating Window in N-dimensional space, calculated at each value of the external conditions $\sigma_i$.

All of the other above-described single-critical control parameter properties and methods are still applicable to the multiple critical control parameter case, with the generalization expressed by equation (18), or in special cases equation (19).

Example Risk Optimization Workflow for a Single Critical Control Parameter

The following example uses the definitions and relationships described above to provide a method by which to select the lowest-risk drilling system among a collection of candidate drilling systems for drilling a section of a wellbore through the same formation, i.e., subjected to the same external conditions.

1. Identify the N candidate drilling systems forming the collection $\{S_1, \ldots, S_N\}$
2. Varying the external conditions $\sigma$, calculate the upper $X_2$ and lower $X_1$ thresholds for the critical parameters X for each candidate drilling system S and for each external condition value $\sigma$.
   a. Organize the results in the matrices $X_2$ and $X_1$ $$
{}^2X = \begin{pmatrix} {}^2x(S_1, \sigma_1) & \cdots & {}^2x(S_N, \sigma_1) \\ \vdots & \ddots & \vdots \\ {}^2x(S_1, \sigma_M) & \cdots & {}^2x(S_N, \sigma_M) \end{pmatrix} \stackrel{def}{=} \begin{pmatrix} {}^2x_{1,1} & \cdots & {}^2x_{N,1} \\ \vdots & \ddots & \vdots \\ {}^2x_{1,M} & \cdots & {}^2x_{N,M} \end{pmatrix}
$$

$$
{}^1X = \begin{pmatrix} {}^1x(S_1, \sigma_1) & \cdots & {}^1x(S_N, \sigma_1) \\ \vdots & \ddots & \vdots \\ {}^1x(S_1, \sigma_M) & \cdots & {}^1x(S_N, \sigma_M) \end{pmatrix} \stackrel{def}{=} \begin{pmatrix} {}^1x_{1,1} & \cdots & {}^1x_{N,1} \\ \vdots & \ddots & \vdots \\ {}^1x_{1,M} & \cdots & {}^1x_{N,M} \end{pmatrix}
$$

3. Calculate the Operating Window width Matrix OP and Risk Matrix $$
OP = X_2 - X_1
$$

$$
R \equiv r_{i,j} = \begin{cases} \dfrac{1}{op_{i,j}} & \text{if } op_{i,j} \neq 0 \\ 10^5 & \text{if } op_{i,j} = 0 \end{cases}
$$

4. Calculate the Section Risk, $\mathfrak{H}_n$ for $s_n$, the n-th candidate drilling system, with the Scalar Product of the risk matrix R with the unitary matrix $\tilde{U}_n$ as follows:

$$
\boxed{\mathfrak{H}_n = \frac{1}{M}\sum_{i=1}^{M} r_{i,n} = \frac{1}{M} \cdot R \cdot \tilde{U}_n}
$$

$$
\tilde{U}_n = \begin{pmatrix} 0 & 1 & 0 \\ \vdots & \vdots & \vdots \\ 0 & 1 & 0 \end{pmatrix}
$$

(This method of calculating the scalar product between the matrices R and $U_n$ is also applicable to the case of a system controlled by more than one critical parameter x, using standard Tensor calculus, as exemplified in the multiple critical parameter workflow example below.)

5. Test whether the n-th system $S_n$ is $\sigma$-robust, by determining if the following relationship is true for the column n:

$$
\min_{i=1,\ldots,M}({}^2x_{i,n}) > \max_{i=1,\ldots,M}({}^1x_{i,n})
$$

6. Among all n candidate drilling systems of the collection $\Omega$ of $\sigma$-robust drilling systems, select the one having the smallest Section Risk $\mathfrak{H}_n$.

As will be apparent, the above outline workflow is set forth merely by way of example. Alternative workflow solutions, other than that set forth above, will be apparent to the skilled person for putting into effect the methods of the present invention. The present invention includes all such alternative workflow solutions within the scope of the following claims.

Example Risk Optimization Workflow for Multiple Critical Control Parameters

In the following further workflow example, standard Tensor calculus notation is used. In order to make it easier to follow the calculations, the example is based on the above-noted case of a drilling system subjected to three independent critical control parameters.

This example is given to demonstrate how the foregoing example risk optimization workflow for a single critical control parameter can be generalized to the case of multiple critical control parameters using Tensor calculus. Generalizing the matrices ${}^1X$ and ${}^2X$ used in the above workflow example for a generic critical control parameter $x_i$, the following notation is used:

$$
{}^2X_i = \begin{bmatrix} {}^2x_i(S_1, \sigma_1) & \cdots & {}^2x_i(S_N, \sigma_1) \\ \vdots & \ddots & \vdots \\ {}^2x_i(S_1, \sigma_M) & \cdots & {}^2x_i(S_N, \sigma_M) \end{bmatrix} = \begin{bmatrix} {}^2x_{i,1,1} & \cdots & {}^2x_{i,N,1} \\ \vdots & \ddots & \vdots \\ {}^2x_{i,1,M} & \cdots & {}^2x_{i,N,M} \end{bmatrix}
$$

and $$
{}^1X_i = \begin{bmatrix} {}^1x_i(S_1, \sigma_1) & \cdots & {}^1x_i(S_N, \sigma_1) \\ \vdots & \ddots & \vdots \\ {}^1x_i(S_1, \sigma_M) & \cdots & {}^1x_i(S_N, \sigma_M) \end{bmatrix} = \begin{bmatrix} {}^1x_{i,1,1} & \cdots & {}^1x_{i,N,1} \\ \vdots & \ddots & \vdots \\ {}^1x_{i,1,M} & \cdots & {}^1x_{i,N,M} \end{bmatrix}
$$

where each i indicates the corresponding critical parameter $x_i$ and each element of the above matrix ${}^2X$ is the value that parameter takes to trigger the failure mode 2 of that critical parameter, whilst each element of the above matrix ${}^1X$ is the value that parameter takes to trigger the failure mode 1 of that critical parameter, for the system $S_j$ subjected to the external condition $\sigma_k$.

Applying standard Tensor notation helps to simplify the further explanation. For instance, alternate duplicated indices indicate that summation over this index is to be carried across all the possible values for the index, for instance:

$$x_{j,t,s} \cdot y_{js}^{t} \stackrel{def}{=} \sum_{t=1}^{t=N} x_{j,t,s} \cdot y_{j,t,s}$$

Using equation (16), the size OP of the Operating Window in the case of a multiple critical control parameter system is then expressed as:

$$OP \stackrel{def}{=} op_{j,k} = \int \prod_{i=1}^{N} [1 - \theta({}^{1}x_{i,jk} - x_i) - \theta(x_i - {}^{2}x_{i,jk})] dx_i$$

As already derived for equation (17), this can take the simple form of $$OP \stackrel{def}{=} op_{j,k} \prod_{i=1}^{N} [{}^{2}x_{i,j,k} - {}^{1}x_{i,j,k}]$$

(Note that the index i is absorbed in both cases, in the sense that equation (17) requires multiplying over all the possible values that this index takes. As such, the value of OP is independent on "i", resulting in a number (and not a tensor) which depends only on the system S and the condition α—this makes it possible to calculate 1/OP and derive the risk matrix R.)

The instantaneous risk tensor is therefore expressed as:

$$R = r_{j,k} = \begin{cases} \dfrac{1}{op_{j,k}} & \text{if } op_{j,k} \neq 0 \\ 10^5 & \text{if } op_{j,k} = 0 \end{cases}$$

Therefore, for the system $S_n$ within the collection of systems $\{S_1, \ldots, S_n, \ldots S_N\}$ subjected to M external conditions $\sigma_k$ and controlled by many independent parameters $x_i$, the Section Risk is still given (formally) by the normalized scalar product of the array R and the unitary matrix $U_n$:

$$\boxed{\mathfrak{H}_n = \frac{1}{M} \sum_{j=1}^{M} r_{j,k} = \frac{1}{M} R \cdot U_n}$$

Independent Critical Control Parameters Having Dependent Failure Mode Boundaries In the most general case, one could observe that although the critical control parameters are independent (therefore, they can be varied independently), the failure points ${}^{1}x_i$ and ${}^{2}x_i$ might be dependent.

As an example based on the case of a drilling system having three critical control parameters, as discussed above, the resonance frequencies of a BHA are a function of the weight on system W (a critical control parameter) applied. If the weight on system is varied, the values of the rotary speeds ${}^{1}$RPM and ${}^{2}$RPM at which resonance triggers one of the respective failure modes will also vary. This is a typical example of independent critical control parameters with dependent failure mode boundaries.

The approach set forth above is capable of analyzing the more general case where dependencies exist between failure mode boundary positions and one (or more) critical parameters. The assumption that the failure modes are independent is still valid. Here, the situation being considered is that the change of one critical control parameter may affect the position of the boundary of the failure mode of a different critical control parameter. The failure modes are still independent, as well as the critical parameters, however the relationship affects the boundary values at which the failure modes are triggered. A computer program can be made to analyze the general case and iterate against multiple systems and external conditions.

Consider again the above example of a drilling system subjected to three independent parameters (weight on system=W, rotary speed=RPM, and flow rate=F). As known, the drilling system's natural resonance frequencies are a function of the weight on system. A standard directional drilling program, or another drilling simulation program or the like, can be used to plot this relationship. Such a plot is shown in FIG. 7, which shows how the values of rotary speed RPM at which resonance frequencies of a drilling system BHA, as may correspond to one or more failure modes, are excited vary as the weight on system W is varied from around 5,000 to 35,000 lbs (about 2,268 to 15,876 kg).

Figure 7:
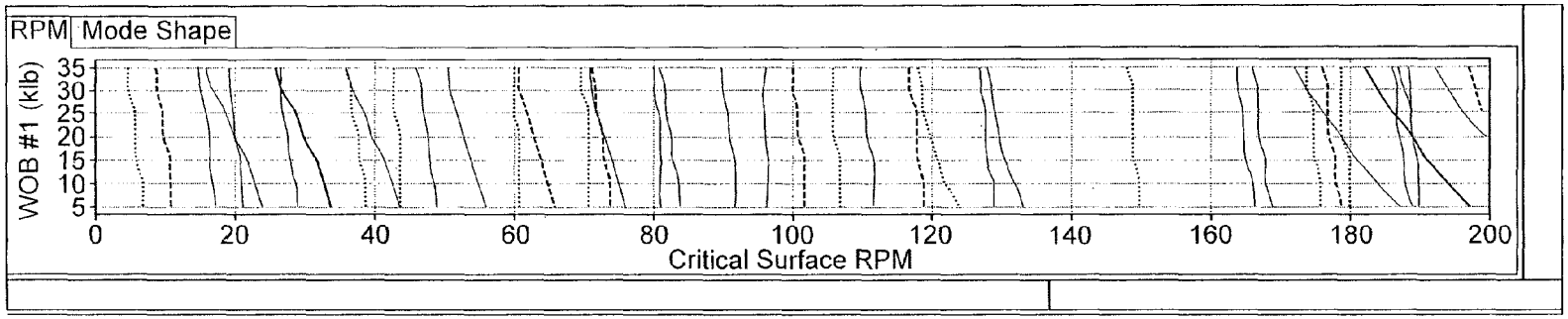
FIG. 7 shows how the boundary values of one critical control parameter, at which one or more failure modes may be triggered, may vary as the value of another critical control parameter is varied.

In FIG. 7, each dashed line represents a resonant frequency for one or more of the tools in the BHA. Each tool can have one or many resonant frequencies, and may have several individual components with different resonant frequencies. Some of those resonant frequencies may be deemed to initiate a failure mode, whilst others may not. Any two adjacent failure mode-initiating resonant frequencies may be used to set the upper and lower limits for the rotary speed RPM, thereby representing the onset of failure mode 1 and failure mode 2 for that critical parameter. Also shown in FIG. 7 are feint lines, which run in parallel with each resonant frequency dashed line, on each side thereof. These represent nominal upper and lower design limits which are sometimes used in present system design to indicate non-operational windows surrounding each resonant frequency. The drilling system is normally controlled so as not to be operated within these limits, i.e., so as not to approach too closely to the resonant frequency. The upper and lower limits corresponding to failure modes 1 and 2 for the rotary speed RPM may also be set in this way, so as to define the onset of failure mode 1 or 2 as approaching within a certain approximation of the respective resonant frequency. Equally, a more investigative analysis may be done to define more precise values for the rotary speed at which the vibrations approach the resonant frequency sufficiently closely to risk damaging the system.

The relationship can be well approximated by a polynomial, and a computer could numerically approximate that relationship by means of a suitable polynomial expression of n-degrees. For simplicity, in this example, a linear approximation is adopted, in the form: RPM=a+Wb.

Here, as the weight on system W changes, the boundary value for the rotary speed RPM at which failure mode 1 (for instance, the first resonance frequency is excited) is triggered changes. The failure mode (resonance), however, remains the same at all times, but the value of RPM at which this failure mode is triggered changes as the other independent critical control parameter W changes.

For this system, the failure mode trigger points are generally defined in table 12 below.

TABLE 12

| Critical Parameter | ${}^1x_i$ -failure mode 1 point | ${}^2x_i$ -failure mode 2 point |
|---|---|---|
| Rotary speed | ${}^1RPM = {}^1a + {}^1b \cdot W$ | ${}^2RPM = {}^2a + {}^2b \cdot W$ |
| Weight on system | ${}^1W = W_{min}$ | ${}^2W = W_{max}$ |
| Flow rate | ${}^1F = F_{min}$ | ${}^2F = F_{max}$ |

Using equation (16) it is possible to calculate the size of the Operating Window for this system, noting that $R_{12}=1$ (i.e., $P_{12}=0$) only within the boundaries defined in the table above (and noting that, in this case, equation (17) is not applicable because the failure mode boundaries are not independent), $$\begin{aligned} OP_{12}(S,\sigma) &= \int \prod_{i=1}^{N} [1-\theta({}^1x_i-(S,\sigma)-x_i)-\theta(x_i-{}^2x_i(S,\sigma))]dx_i \\ &= \int dF \int\int_M dW \cdot dRPM \\ &= ({}^2F-{}^1F)\cdot \int_{{}^1W}^{{}^2W} dW \cdot \int_{{}^1RPM}^{{}^2RPM} dRPM \\ &= ({}^2F-{}^1F)\cdot \int_{{}^1W}^{{}^2W} [{}^2RPM-{}^1RPM]\,dW \\ &= ({}^2F-{}^1F)\cdot \int_{{}^1W}^{{}^2W} [({}^2a+{}^2b\cdot W)-({}^1a+{}^1b\cdot W)]dW \\ &= ({}^2F-{}^1F)\cdot \left[({}^2a-{}^1a)\cdot({}^2W+{}^1W)+\frac{({}^2b+{}^1b)}{2}\cdot({}^2W^2-{}^1W^2)\right] \end{aligned} \tag{a.1}$$

Equation (a.1) can be written more explicitly, taking away the indices (for a system S under external condition σ):

$$OP_{12} = (F_{max}-F_{min})\cdot[A\cdot(W_{max}-W_{min})+B\cdot(W_{max}^2-W_{min}^2)]$$

where:

$$A \equiv ({}^2a-{}^1a) \text{ and } B \equiv \frac{({}^2b-{}^1b)}{2}$$

From here it is possible, using algebra, to derive the Instantaneous Risk, and from there the Section Risk, as before. It should also be note that the expression (a.1) above is applicable to many systems, and is susceptible to calculation by a computer. Equally, numerical calculus can be used in the case of a polynomial interpolation being used for the relationship between weight on system and the rotary speed at which the system's natural resonance frequencies are excited.

In a very similar fashion, equation (16) is valid even in the case of multiple interdependent relationships between failure mode boundaries.

As a final note, the skilled person will recognize that the separation between failure modes 1 and 2 is arbitrary and generic in the foregoing examples and calculations. This means that it is possible to analyze and optimize the (Section) Risk for a drilling system against any chosen couple of failure modes for the system: the same mathematics applies, with the same considerations, workflow and formal results.

As regards practical applications, the methods disclosed herein can use real time data to update the calculated instantaneous risk for undrilled portions of the wellbore section being drilled, and are therefore able to re-calculate in real time the section risk for the drilling system being used. This permits the system to display the actual instantaneous working point for the system (i.e., the current values of the critical control parameters) within the operating window or windows of the critical control parameters—either for one or more of the critical control parameters individually, or, for a system having N critical control parameters, within the N-dimensional risk hypercube volume.

Equation a.1, for instance, can be calculated using real time data. This allows the parameters of the fitting polynomial to be calculated in real time and the model adjusted accordingly. In this regard, fitting polynomial coefficients associated with the one or more drilling systems under consideration either can be determined in operation or can be previously determined or calculated theoretically and then stored in a database for use in the real-time drilling calculations, in order to speed-up the real-time calculations, e.g., by using characteristic failure curves representing the failure mode boundary dependencies.

The invention claimed is:

1. A method for assessing risk associated with drilling a section of a wellbore in a formation using a drilling system, comprising:

defining one or more critical control parameters for the drilling system; and identifying one or more failure modes of the drilling system associated with each critical control parameter which may arise during drilling the section of the formation;

assessing each critical control parameter for a fixed set of external drilling conditions corresponding to a position along the section of the wellbore to determine a probability of triggering each failure mode associated with that control parameter as the critical control parameter varies;

determine a value of an instantaneous risk of the drilling system failing at each position along the section of the wellbore based on an assessed probability of triggering each failure mode associated with each critical control parameter as the critical control parameter varies;

plotting an instantaneous operating point of the drilling system, corresponding to an instantaneous value of each of the critical control parameters, within a respective operating window;

calculating a value of the section risk as the additive risk of the instantaneous risk values; and adjusting at least one of a configuration of the drilling system or the critical control parameter for the drilling system to maximize or maintain at least one performance characteristic while minimizing, reducing, or capping the value of the section risk; and updating the instantaneous risk of the configuration of the drilling system based on real time data such that a selected drilling system configuration provides a least risk of triggering the one or more failure modes.

2. The method of claim 1, wherein each critical control parameter is assessed for each of multiple sets of external drilling conditions corresponding to respective multiple positions along the section of the wellbore, and wherein the assessed probability of triggering each failure mode associated with each critical control parameter as the critical control parameter varies is used to define the operating window for the drilling system at each position along the section of the wellbore.

3. The method of claim 1, wherein the assessed probability of triggering each failure mode associated with each critical control parameter as the critical control parameter varies is used to define the operating window for the drilling system.

4. The method of claim 3, further comprising determining a width of each operating window for one or more individual critical control parameters.

5. The method of claim 4, further comprising plotting an instantaneous operating point of the system, corresponding to an instantaneous value of each of the critical control parameters, within each respective operating window.

6. The method of claim 3, wherein the system has N critical control parameters and further comprising determining an N-dimensional volume corresponding to the size of each operating window.

7. The method of claim 3, further comprising assessing whether the drilling system is robust to variation of the external drilling conditions throughout the drilling of the section of the wellbore.

8. The method of claim 1, wherein the assessed probability of triggering each failure mode associated with each critical control parameter as the critical control parameter varies is used to determine a value of the risk of the drilling system failing if it is used for drilling the section of the wellbore.

9. The method of claim 1, further comprising a value of the risk of the drilling system failing if it is used for drilling the section of the wellbore as a whole by calculating the scalar product of a unitary matrix representative of the drilling system, or of multiple candidate drilling systems including said drilling system, with a risk matrix representative of the instantaneous risk of any one of the failure modes arising in the or each drilling system configuration as multiple critical control parameters are varied at substantially every position along the section of the wellbore.

10. The method of claim 1, wherein assessing each critical control parameter may be done by simulating or otherwise mathematically modeling drilling the section of the wellbore with the drilling system, or by measuring the effect of varying the critical control parameters during an actual drilling operation using the drilling system, or by a combination of these.

11. The method of claim 1, wherein the critical control parameters are independent control parameters for conducting drilling of the section of the wellbore with the drilling system.

12. A method for optimizing the performance of a drilling system for drilling a section of a wellbore comprising:

defining one or more critical control parameters for the drilling system;

assessing risk associated with drilling the section of the wellbore using the drilling system, wherein assessing the risk associated with drilling the section of the wellbore using the drilling system comprises one of:

providing a probabilistic model for the risk of the drilling system triggering failure modes during drilling and assessing the risk of the drilling system triggering one of said failure modes under a variation of the one or more critical control parameters during drilling of the section based on said model by determining a value of instantaneous risk of triggering a failure mode at multiple points along the section of the wellbore, and calculating a value of the section risk as the additive risk of the instantaneous risk values; or identifying one or more failure modes of the drilling system associated with each critical control parameter which may arise during drilling the section of the formation, assessing each critical control parameter for a fixed set of external drilling conditions corresponding to a position along the section of the wellbore to determine a probability of triggering each failure mode associated with each critical control parameter as the critical control parameter varies, wherein the assessed probability of triggering each failure mode associated with each critical control parameter as the critical control parameter varies is used to determine a value of the instantaneous risk of the drilling system failing at each position along the section of the wellbore, and calculating a value of the section risk as the additive risk of the instantaneous risk values;

adjusting at least one of a configuration of the drilling system or the control parameter for the drilling system to maximize or maintain at least one performance characteristic while minimizing, reducing, or capping risk;

plotting an instantaneous operating point of the drilling system, corresponding to an instantaneous value of each of the critical control parameters, within a respective operating window; and updating the instantaneous risk of the configuration of the drilling system based on real time data such that a selected drilling system configuration provides a least risk of triggering the one or more failure modes.

13. A method for assessing the ability of a drilling system to drill a section of a wellbore without triggering a failure mode of the drilling system, comprising:

providing a probabilistic model for the risk of the drilling system triggering a failure mode during drilling under the variation of one or more critical control parameters;

assessing the risk of the drilling system triggering one of said failure modes during drilling of the section based on said model by determining a value of instantaneous risk of triggering a failure mode at multiple points along the section of the wellbore, and calculating a value of the section risk as the additive risk of the instantaneous risk values;

identifying at least one of an upper or lower threshold values for each critical control parameter, at one or more points along the section of the wellbore to be drilled, respectively above or below which thresholds the risk of a failure mode of the drilling system being triggered is deemed to be unacceptable;

adjusting at least one of the configuration of the drilling system or the control parameter for the drilling system to maintain the critical control parameter below or above the identified upper or lower threshold values to minimize, reduce, or cap the risk of a failure mode of the drilling system being triggered;

plotting an instantaneous operating point of the drilling system, corresponding to an instantaneous value of each of the critical control parameters, within a respective operating window; and updating the instantaneous risk of the configuration of the drilling system configuration based on real time data such that a selected drilling system configuration provides a least risk of triggering the one or more failure modes.

14. The method of claim 13, further comprising:

defining an operation window for the drilling system at the or each point as being the range of values for each control parameter within which the risk of a failure mode of the drilling system being triggered is deemed to be acceptable, and determining whether the drilling system is robust to variations in one or more drilling conditions during drilling of the section by testing whether any single set of values of the control parameters can be used continuously throughout drilling of the section while remaining within the operating window at every point.

15. The method of claim 13, wherein the method further comprises identifying any points for which there is no available operating window due to every available value of one or more of the control parameters being above the respective upper threshold or below the respective lower threshold.

16. The method of claim 15, further comprising defining one or more transition points adjacent to any points having no available operating window, identifying at least one of the upper or lower threshold values for each control parameter, at each transition point, respectively above or below which thresholds the risk of a failure mode of the drilling system being triggered is deemed to be unacceptable, and defining an operation window for the drilling system at each transition point as being the range of values for each control parameter within which the risk of a failure mode of the drilling system being triggered is deemed to be acceptable.

17. The method of claim 15, further comprising:

dividing the section into two or more parts and re-assessing the ability to drill the section of a wellbore by using a first drilling system for a part of the section including a point at which no operating window was available and using a second drilling system for at least part of the section for which every point had an available operating window; and determining whether the first and second drilling systems are robust to variations in one or more drilling conditions during drilling of the respective parts of the section by testing whether any single set of values of the control parameters can be used continuously throughout drilling of the respective part while remaining within an available operating window at every point.

* * * * *